US006956534B2

(12) United States Patent
Hagiwara

(10) Patent No.: US 6,956,534 B2
(45) Date of Patent: Oct. 18, 2005

(54) METHOD AND APPARATUS FOR IMPROVING ANTENNA EFFICIENCY

(75) Inventor: Yoshihiro Hagiwara, Tokyo (JP)

(73) Assignee: Cocomo Mb Communications, Inc., Tokyo (JP)

( * ) Notice: Subject to any disclaimer, the term of this patent is extended or adjusted under 35 U.S.C. 154(b) by 0 days.

(21) Appl. No.: 10/448,953

(22) Filed: May 30, 2003

(65) Prior Publication Data

US 2004/0201534 A1 Oct. 14, 2004

Related U.S. Application Data

(63) Continuation-in-part of application No. 10/412,371, filed on Apr. 11, 2003, now Pat. No. 6,891,512, which is a continuation-in-part of application No. 10/160,747, filed on May 30, 2002, now Pat. No. 6,600,896, and a continuation-in-part of application No. 09/724,535, filed on Nov. 27, 2000, now abandoned.

(30) Foreign Application Priority Data

Apr. 22, 2003 (JP) ..... 2003-116664

(51) Int. Cl.[7] ..... H01Q 13/00
(52) U.S. Cl. ..... 343/773; 343/841
(58) Field of Search ..... 343/702, 841, 343/773; 455/89, 90.3

(56) References Cited

U.S. PATENT DOCUMENTS

| | | | | | |
|---|---|---|---|---|---|
| 2,368,663 | A | * | 2/1945 | Kandoian | 343/790 |
| 3,787,865 | A | * | 1/1974 | MacDowell et al. | 343/703 |
| 3,942,180 | A | * | 3/1976 | Rannou et al. | 343/725 |
| 4,428,078 | A | | 1/1984 | Kuo | |
| 4,698,639 | A | | 10/1987 | Mead et al. | |
| 4,845,505 | A | | 7/1989 | Ohe et al. | 343/712 |
| 4,847,561 | A | | 7/1989 | Soohoo | |
| 4,851,859 | A | * | 7/1989 | Rappaport | 343/790 |
| 4,864,320 | A | | 9/1989 | Munson et al. | 343/833 |
| 5,230,085 | A | | 7/1993 | Loposer | |
| 5,302,960 | A | | 4/1994 | Boers | |
| 5,335,366 | A | * | 8/1994 | Daniels | 455/575.5 |
| 5,373,304 | A | * | 12/1994 | Nolan et al. | 343/841 |
| 5,526,005 | A | * | 6/1996 | Koo | 343/702 |
| 5,557,287 | A | * | 9/1996 | Pottala et al. | 343/702 |
| 5,608,416 | A | | 3/1997 | Champion et al. | 343/773 |
| 5,613,221 | A | * | 3/1997 | Hunt | 455/575.5 |
| 5,694,137 | A | * | 12/1997 | Wood | 343/702 |
| 5,696,861 | A | | 12/1997 | Schimmeyer et al. | |
| 5,999,142 | A | * | 12/1999 | Jang | 343/834 |
| 6,057,756 | A | | 5/2000 | Engellenner | |
| 6,081,728 | A | | 6/2000 | Stein et al. | |
| 6,095,820 | A | * | 8/2000 | Luxon et al. | 343/702 |
| 6,097,340 | A | * | 8/2000 | Chang | 343/702 |
| 6,151,354 | A | | 11/2000 | Abbey | |
| 6,160,405 | A | | 12/2000 | Needle et al. | |
| 6,891,512 | B2 | * | 5/2005 | Chadwick | 343/773 |

FOREIGN PATENT DOCUMENTS

| | | |
|---|---|---|
| DE | 1 441 103 | 10/1968 |
| EP | 0 055 591 | 7/1982 |
| GB | 926599 | 12/1961 |
| GB | 1 532 010 | 11/1978 |
| WO | WO 97/44909 A | 11/1997 |
| WO | WO 01/54224 A1 | 7/2001 |

OTHER PUBLICATIONS

Chandra, Mouly M., et al., "Analytical Evaluation of Radiation Patterns of a Tacan Antenna", *Proceedings of the National Aerospace and Electronics Conference (NAECON), Dayton OH (1989) New York IEEE, US vol. 1, Conf. 41*, (May 22, 1989), 187–192.

* cited by examiner

*Primary Examiner*—Tan Ho
(74) *Attorney, Agent, or Firm*—Deborah A. Peacock; Peacock Myers, P.C.

(57) ABSTRACT

A method and apparatus for improving antenna efficiency. A non-grounded conductive object is placed near an antenna. An insulative layer lies between the object and the antenna. The antenna used is preferably a multiband antenna, such as a discone type antenna.

25 Claims, 26 Drawing Sheets

S/N FOR MELCO ANTENNA
WITHOUT A NON-GROUNDED CONDUCTIVE OBJECT

SIGNAL AND NOISE FOR MELCO ANTENNA
WITHOUT A NON-GROUNDED CONDUCTIVE OBJECT

SIGNAL RANGE FOR MELCO ANTENNA
WITHOUT A NON-GROUNDED CONDUCTIVE OBJECT

S/N FOR DISCONE TYPE ANTENNA
WITH A CURVED NON-GROUNDED CONDUCTIVE OBJECT

SIGNAL AND NOISE MEASUREMENT FOR DISCONE TYPE ANTENNA WITH A CURVED NON-GROUNDED CONDUCTIVE OBJECT

SIGNAL RANGE FOR DISCONE TYPE ANTENNA
WITH A CURVED NON-GROUNDED CONDUCTIVE OBJECT

SIGNAL AND NOISE READINGS FOR THE PC CARD
WITH NO EXTERNAL ANTENNA

SIGNAL AND NOISE READINGS FOR DISCONE TYPE ANTENNA WITH A CURVED NON-GROUNDED CONDUCTIVE OBJECT ADDED

SIGNAL AND NOISE READINGS FOR MELCO TYPE ANTENNA WITHOUT A NON-GROUNDED CONDUCTIVE OBJECT

METHOD AND APPARATUS FOR IMPROVING ANTENNA EFFICIENCY

CROSS-REFERENCE TO RELATED APPLICATIONS

This application is a continuation-in-part application of U.S. patent application Ser. No. 10/412,371, entitled "Antenna", to Chadwick, filed on Apr. 11, 2003, now U.S. Pat. No. 6,891,512 which is a continuation-in-part application of U.S. patent application Ser. No. 09/724,535 entitled "In-Vehicle Exciter", to Chadwick, filed on Nov. 27, 2000 now abandoned and U.S. patent application Ser. No. 10/160,747, entitled "Exciter System and Excitation Methods for Communications Within and Very Near to Vehicles", to Chadwick, et al., filed on May 30, 2002, now U.S. Pat. No. 6,600,896 and the specifications thereof are incorporated herein by reference.

This application claims priority to Japanese Patent Application Serial No. 2003-116664, entitled "Antenna Device", filed on Apr. 22, 2003, and the specification thereof is incorporated herein by reference.

BACKGROUND OF THE INVENTION

1. Field of the Invention (Technical Field)

The present invention relates to an antenna device that improves the Transmit/Receive (T/R) efficiency characteristics of an antenna by improving the signal to noise (S/N) ratio in the radio communications.

2. Description of Related Art

Note that the following discussion refers to a number of publications by author(s) and year of publication, and that due to recent publication dates certain publications are not to be considered as prior art vis-a-vis the present invention. Discussion of such publications herein is given for more complete background and is not to be construed as an admission that such publications are prior art for patentability determination purposes.

Currently, antennas used in wireless LAN, GPS, TV, etc, are typically single-use antenna with frequency bands ranging from MHz, to tens of GHz. Since frequency band (wavelength range) is determined by use, these antennas are designed to be tuned to a specific frequency. For example, IEEE802.11b (wireless LAN), uses a 2.4 GHz band frequency. Reduced Transmit/Receive (T/R) efficiency of single-use antenna can result in limited receiving areas and thus require greater transmitting power.

Since, discone type antennas have the outstanding characteristic of broadband capabilities, it is possible that one antenna may be used for multiple services. However, the discone's gain is lower than a single-use antenna, to date, this has prevented the practical use of discone type antennas for multiple uses.

The practical use of discone type antennas for multiple services can result if the T/R efficiency is improved. This would have a dramatic affect on personal services such as wireless LAN, GPS, etc since they could all be presented with just one antenna.

Conventional antennas, which are used for a specific wavelength, such as the ¼-wavelength grounded antenna, do not always have a sufficient S/N ratio. If the S/N ratio is improved, it will become possible to reduce the transmission power or, likewise, to increase the receiving distance.

Since the discone type antenna is typically used for broadband T/R frequencies, using a discone type antenna for a specific wavelength results in a reduced S/N ratio, when compared with other antennas.

Various technologies have been developed to improve the S/N ratio, such as, electromagnetic wave radar equipment with improved reliability, which allows only a fixed frequency, for Transmitting and Receiving, to pass efficiently, thus controlling the influence of noise. See Japanese Patent Publication No. 11-248835 entitled "Radio Wave Radar Apparatus".

Such radar is equipped with an antenna for Transmitting/Receiving an electromagnetic wave, as well as a shield conducting component that is grounded and covers the antenna of the radar unit. The shield component has a screen for frequency selection in the area facing the antenna. The screen is comprised of a conductive film having multiple holes uniformly arranged in two dimensions. The size and arrangement of the holes are chosen to allow a selected frequency to pass through. This selected frequency is the maximum allowed to pass. The screen, intercepts the noise of frequencies lower than the selected frequency. This screen part can be comprised of multiple conductive films, with holes, arranged in piles. The screen part may also be comprised of a mesh conductive wire, or a conductive film having multiple parallel slits etc.

Japanese Patent Publication No. 01-305606 entitled "Antenna Device with Radome", describes a device consisting of an antenna and a grounded radome that protects the antenna from its natural environment. The radome also provides frequency selectiveness.

Japanese Patent Publication No. 09-083238 entitled "Antenna System for Multi-Wave Common Use" describes an antenna device for multi-waves that can be made smaller by modifying the shape of the discone type antenna.

U.S. patent application Ser. No. 10/412,371 entitled "Antenna", U.S. patent application Ser. No. 10/160,747 entitled "Exciter System and Excitation Methods for Communications Within and Very Near to Vehicles" and U.S. patent application Ser. No. 635,402, entitled "In-Vehicle Exciter", which are incorporated herein by reference, disclose a modified discone exciter, which is used for communications within a vehicle. The present invention is applicable to modified discone type antennas, as well as other types of antennas.

BRIEF SUMMARY OF THE INVENTION

The present invention is directed to the enhancement of antenna efficiency. The invention preferably comprises an antenna, a non-grounded conductive object, and an insulated space lying between the antenna and the non-grounded conductive object. The antenna used in the invention is preferably a discone type antenna comprising a disc, a cone comprising an apex and a base comprising a diameter, with the disc positioned at the apex of the cone, and a feed wire preferably disposed in an interior of the cone and extending outwardly beyond the cone.

The non-grounded conductive object preferably comprises an aluminum or copper material. The material can be substantially flat, but is preferably curved. The curve can be simple, substantially spherical, or cylindrical in nature. A curved non-grounded conductive object comprising an angle of between approximately 60 degrees and approximately 180 degrees is preferred. The thickness of the non-grounded conductive object is preferably less than or equal to approximately ten millimeters in thickness.

The non-grounded conductive object can comprise a double wall. The interior of the double wall may be hollow or can have some insulative material, such as plastic, disposed therein.

The non-grounded conductive object may, but preferably does not, completely enclose the antenna.

The insulated space preferably comprises air, however, plastic or any other insulative material may be used. The insulated space is preferably less than or equal to approximately 50 millimeters in thickness.

The present invention also relates to a method for improving antenna efficiency. In the preferred embodiment, a non-grounded conductive object is placed in a particular position proximate the antenna. A discone type antenna, as discussed above is preferably utilized. The preferred non-grounded conductive object is the same as that discussed above.

A primary object of the present invention is to improve the efficiency of antennas.

A primary advantage of the present invention is that signal to noise ratio in antennas, including those currently in use, is improved in an efficient and cost effective manner.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention is directed to antennas, particularly to those having broadband capabilities, which with improved Transmit/Receive (T/R) efficiency, can result in one antenna being used to T/R the numerous frequency bands of multiple services.

The terms "antenna" and "electromagnetic wave resonance part" are used interchangeably throughout the specification and are intended to mean a system for sending and receiving electromagnetic waves and to generate or produce an electric field. The term "discone" is intended to mean a particular type of antenna or electromagnetic wave resonance part, having disc and cone components, and this term is also intended to cover "disc-cone" or other such exciters having this configuration. In both the claims and the description, the term "substantially flat" is meant to encompass not only those surfaces that are generally flat, but also those surfaces that are flat.

The present invention is an antenna device having an electric wave resonance portion of an antenna and a non-grounded conductive object. The object lies in a particular position proximate the antenna. An insulated space lies between the antenna and the object. The non-grounded conductive object can completely or partially enclose the antenna, and should not be electrically connected to the antenna.

While not completely understood, it is believed that the signal to noise ratio is improved by the present invention because a potential similar to static induction is formed by an interaction with the electromagnetic wave in the non-grounded conductive object when placed in a particular position proximate the electromagnetic wave resonance part of the antenna, thus creating an electromagnetic wave interference function which tends to attenuate noise.

Various kinds of antennas are applicable for the present invention, and an improvement of the T/R efficiency, especially for multiband antennas, has substantial benefits. The discone is one example of a multiband antenna. Since the discone type antenna is capable of very wide bandwidth it can be used for various services, such as FM/AM radio, digital TV, GPS, Wireless LAN, RKE (Remote Keyless Entry), GDO (Garage Door Openers), cellular phones, and PHS (Personal Handy phone Systems).

The following is a description of the basic structure and operating characteristics a discone type antenna relying on J. J. Nail's, *Designing Discone type antennas, Electronics,* August 1953, PP167–169.

Figure 10:
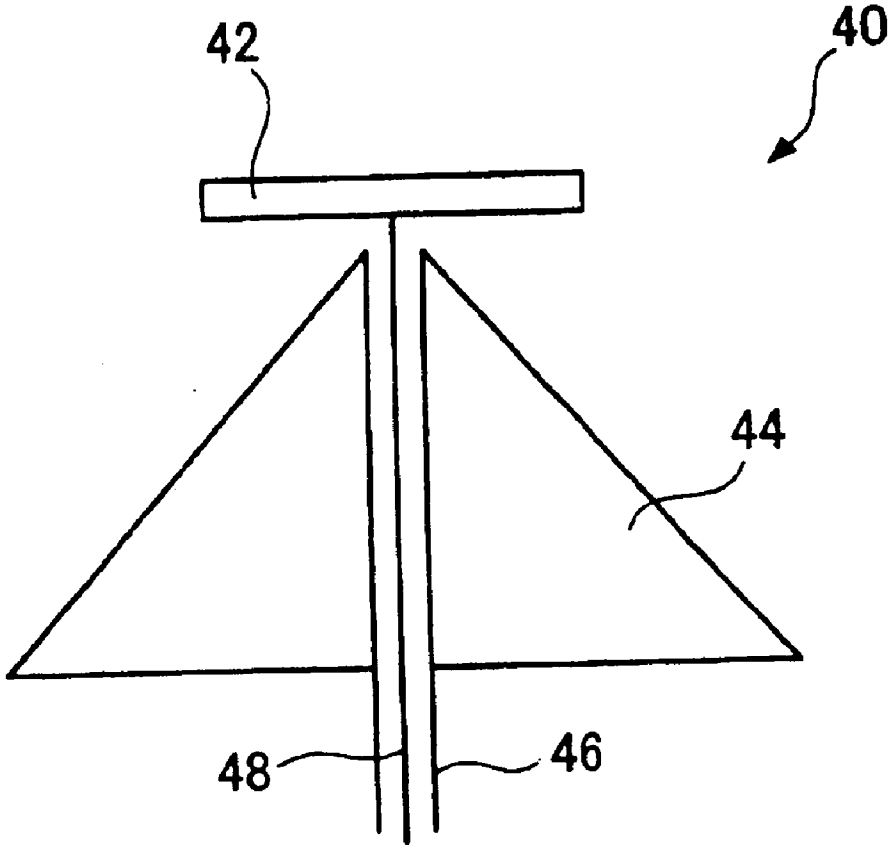
FIG. 10 is a cross section view of a discone type antenna.

The schematic cross section view of discone type antenna 40, of the present invention, is shown in FIG. 10. Discone type antenna 40 comprises disk 42, cone 44, feeding cable 46 and central conductor 48 of feeding cable 46. Electric power is fed to disk 42 through central conductor 48 of feeding cable 46. The cone 44 is typically grounded.

Figure 11:
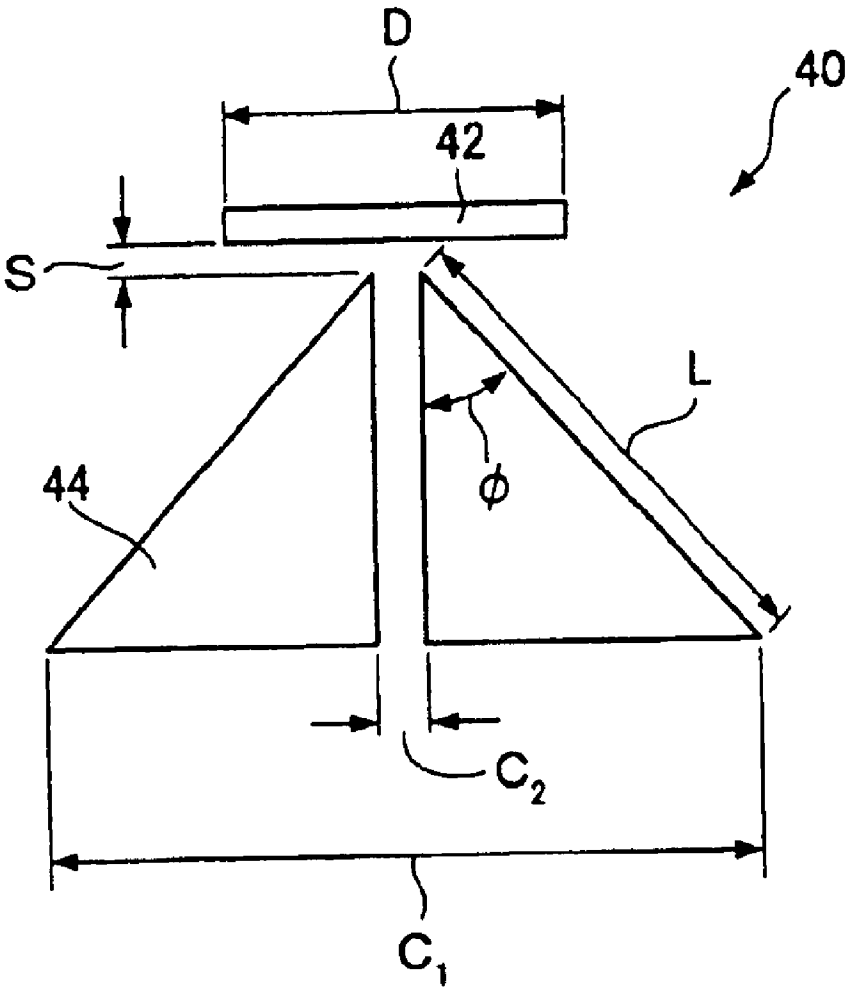
FIG. 11 is a description view of a discone type antenna.

The design parameters of a discone type antenna are shown in FIG. 11. C1 is the maximum diameter of cone 44, C2 is the minimum diameter of cone 44, L is the slant height of cone 44, Φ is the flare angle of cone 44, S is disk-to-cone spacing, and D is the diameter of disk 42.

The bandwidth of a discone type antenna can be determined by evaluating its Standing Wave Ratio (SWR). Frequencies in which the SWR is less than 2 are referred to as the bandwidth of the antenna. The lowest frequency of the discone's bandwidth has a wavelength of approximately 4 times the slant height of the cone.

Using a cone flare angle (Φ) of 60 degrees can result, according to Nail, in a discone antenna with a bandwidth from 400–1300 MHz or more. It is possible to reduce the minimum frequency of the bandwidth by increasing diameter C1 of cone 44. Decreasing space S between disk 42 and cone 44 can increase the maximum frequency of the bandwidth.

Figure 1:
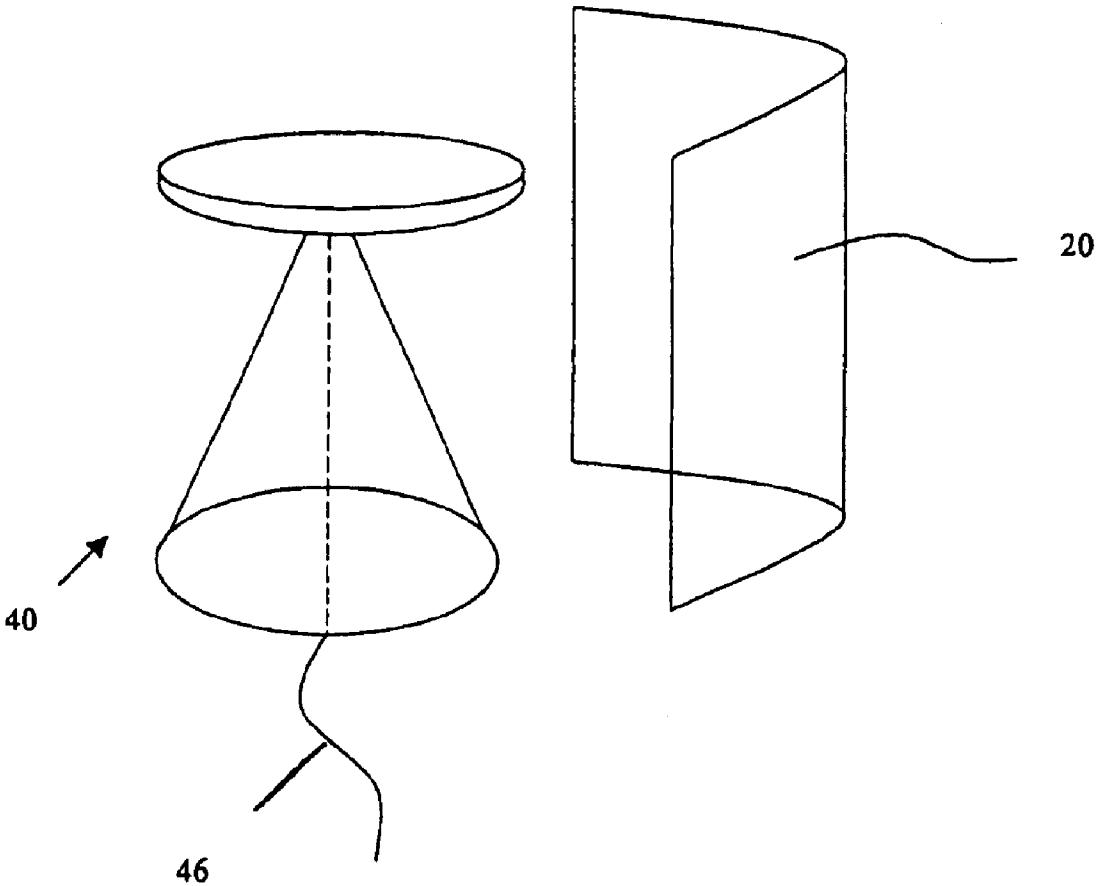
FIG. 1 is a perspective view showing the preferred embodiment of the present invention where the discone type antenna is partially surrounded by a curved non-grounded conductive object.

FIG. 1 shows the preferred embodiment of the current invention. As shown therein, a discone type antenna is used with a curved non-grounded conductive object 20. The curve may have any magnitude of curvature, however, a non-grounded conductive object with a smaller, rather than greater, magnitude of curvature is preferred. A curve of about 60 to about 180 degrees is preferred.

While any conductive substance can be used, it is preferred that the non-grounded conductive object is of aluminum or copper formed into in a curved shape. A thickness of about ten millimeters or less is preferred for the non-grounded conductive object. While holes may be placed in the non-grounded conductive object, this is not the preferred embodiment. A non-grounded conductive object having a height greater than the antenna is preferred, however, a non-grounded conductive object having a height less than the antenna also yields desirable results. A mounting base can be used to dispose the non-grounded conductive object to a number of surfaces and objects.

In the preferred embodiment the insulative material, which lies between the non-grounded conductive object and the antenna, is air, however, plastic or any other insulative material may be used in other embodiments of the present invention.

The present invention is preferably used in conjunction with a broadband antenna, such as a discone type antenna.

Figure 2:
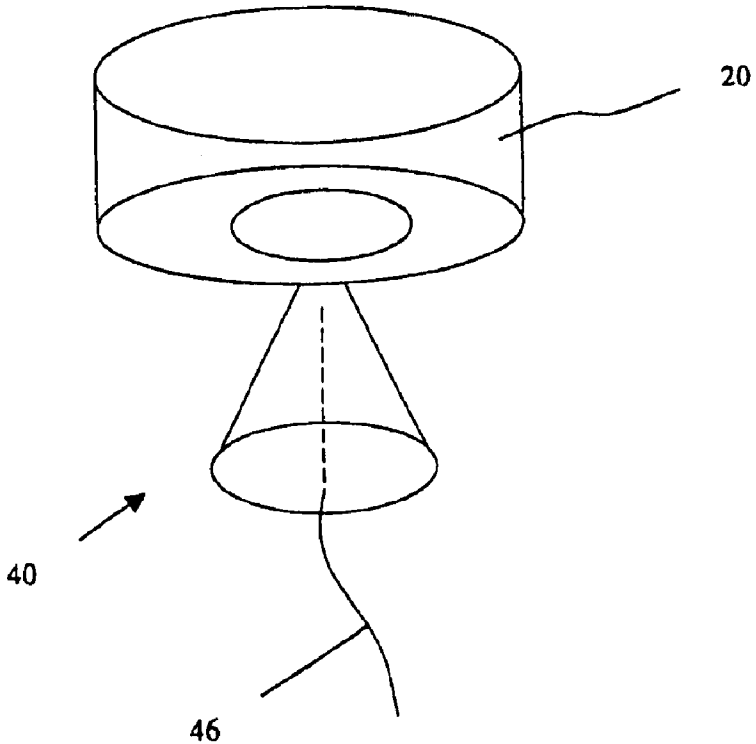
FIG. 2 is a perspective drawing of the current invention showing an open-ended, cylindrical, non-grounded, conductive object, wherein the disk of a discone type antenna has been placed at the opening of the non-grounded conductive object.

FIG. 2 shows an embodiment of the present invention wherein the disk of the discone type antenna is placed at the opening of the non-grounded, open-ended, cylindrically shaped, conductive object 20.

Figure 3:
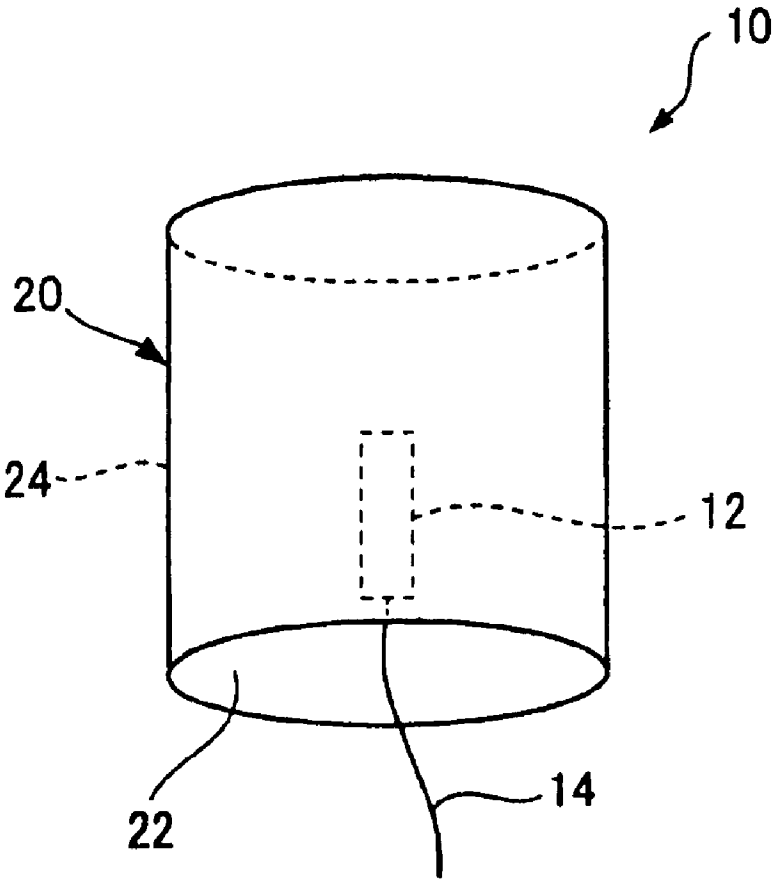
FIG. 3 is a perspective view showing the antenna completely within a cylindrically shaped, open-ended, non-grounded, conductive object.

Another embodiment of the present invention is shown in FIG. 3. The antenna device 10 is comprised of electromagnetic wave resonance part 12 of an antenna and non-grounded conductive object 20 placed near electromagnetic resonance part 12. Antenna feeding part 14 is attached to electromagnetic wave resonance part 12. Electromagnetic wave resonance part 12 is disposed inside non-grounded conductive object 20. Non-grounded conductive object 20 has a shell-like wall 24 that surrounds the upper portion and sides of electromagnetic wave resonance part 12. Opening 22 is located at the bottom of the non-grounded conductive object 20. Wall (shell) 24 of non-grounded conductive object 20 is separated from electromagnetic wave resonance part 12 by air or another insulator.

Figure 4:
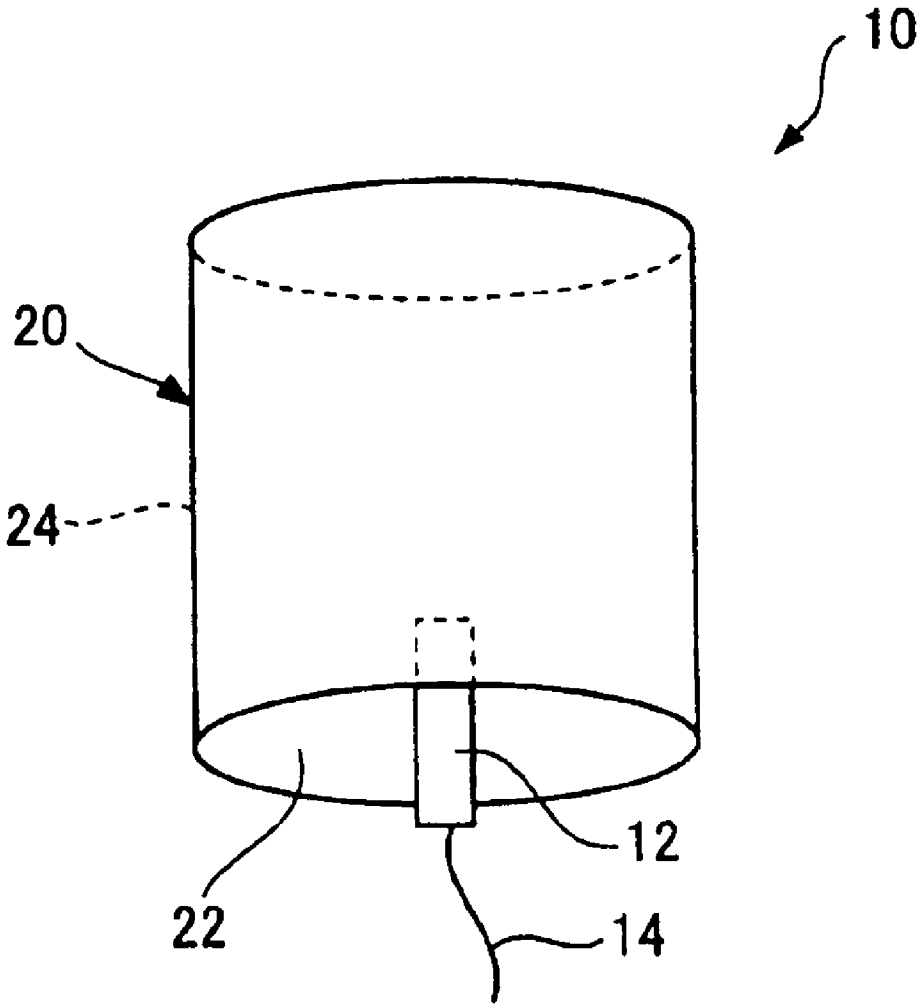
FIG. 4 is a perspective view showing the antenna partially exposed from the open-ended, non-grounded, conductive object.

FIG. 4 is another example of antenna device 10. In this example, electromagnetic wave resonance part 12 is partially exposed under non-grounded conductive object 20.

Figure 5:
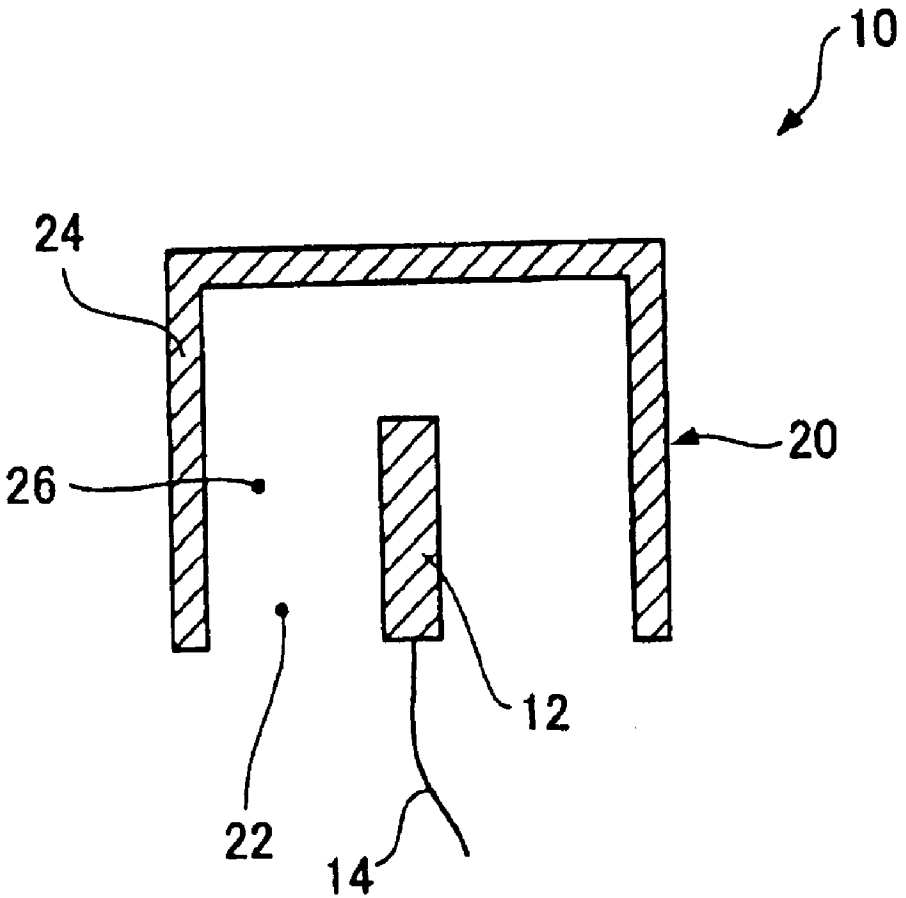
FIG. 5 is a schematic cross section view showing the non-grounded conductive object, placed so as to create sidewalls and a canopy for the antenna.
Figure 6:
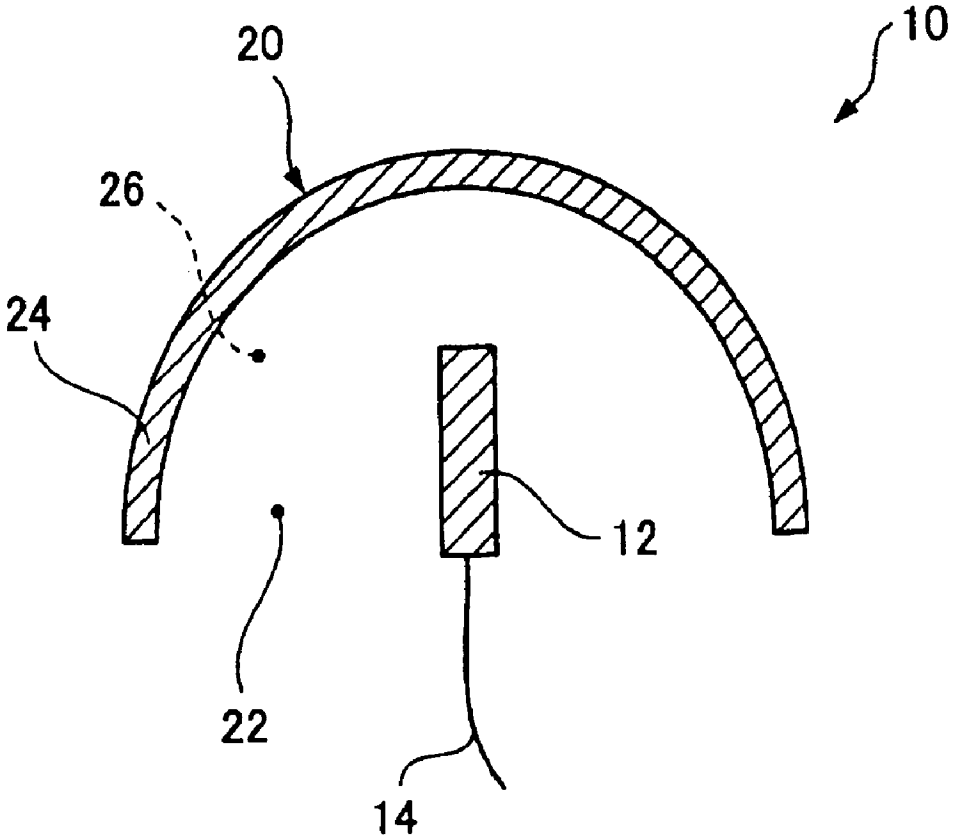
FIG. 6 shows an example in which the non-grounded conductive object is curved partially around the antenna.
Figure 7:
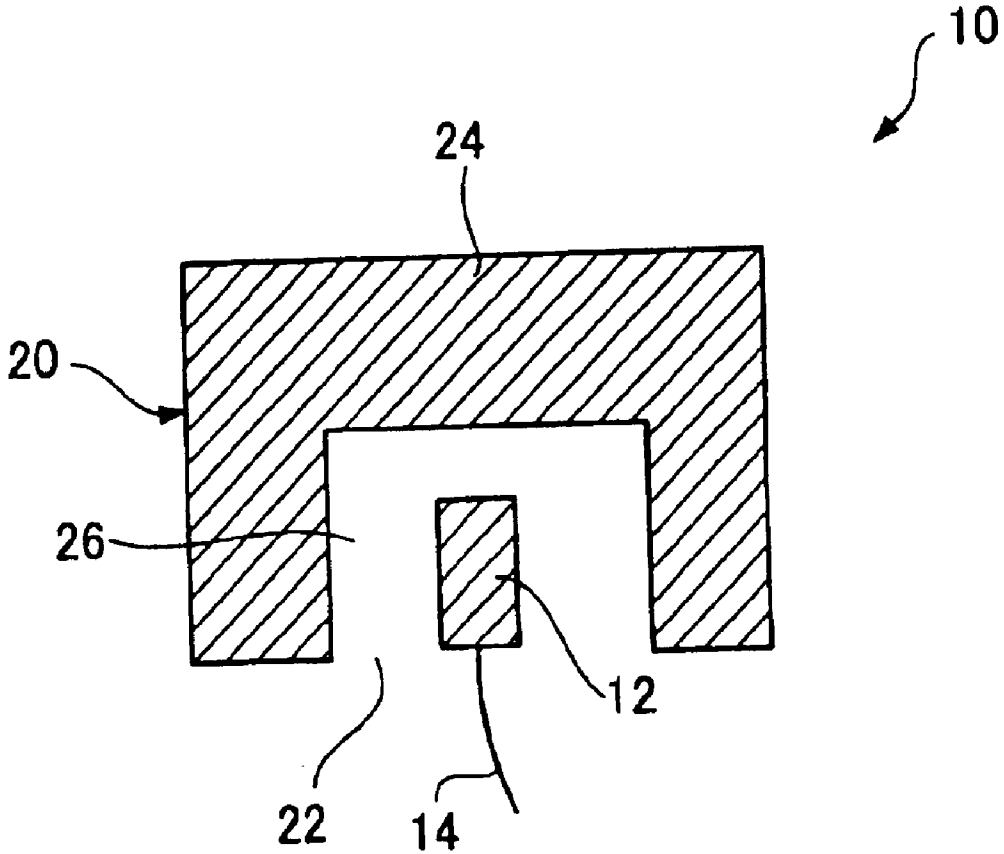
FIG. 7 is a schematic cross section view showing a thick non-grounded conductive object.
Figure 8:
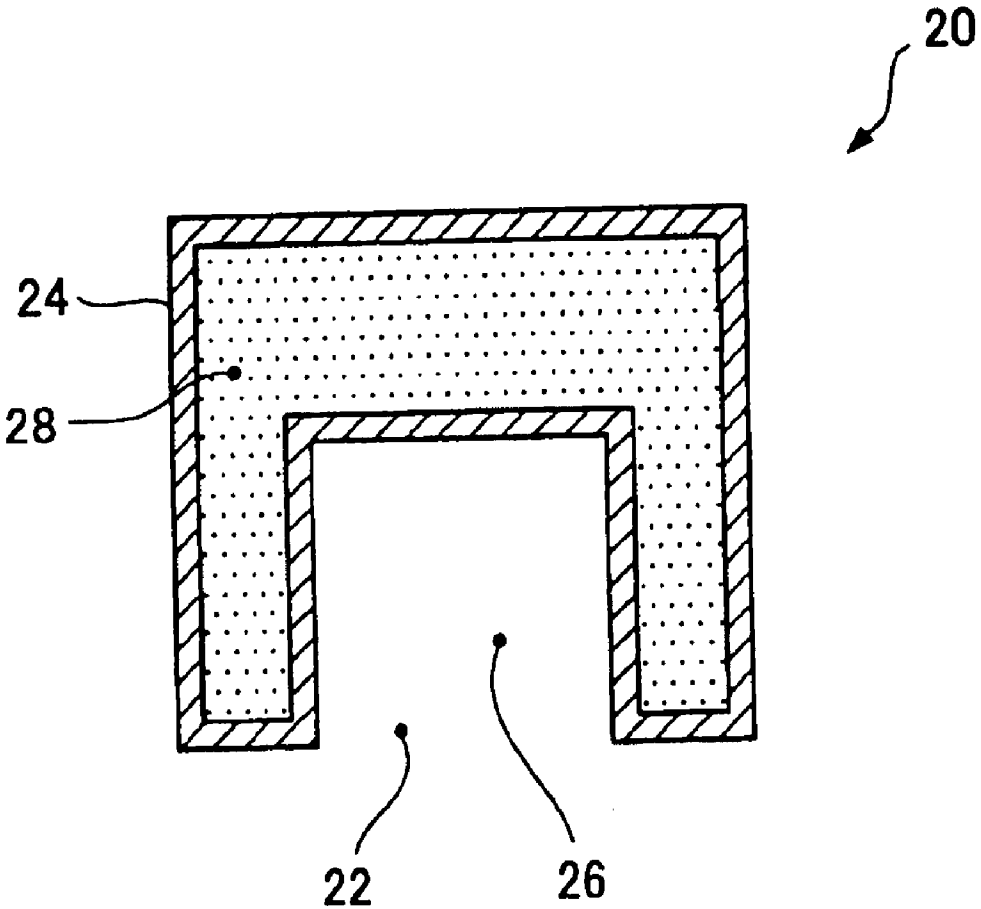
FIG. 8 shows an example in which a non-conductive substance is encased within a double-walled non-grounded conductive object.
Figure 9:
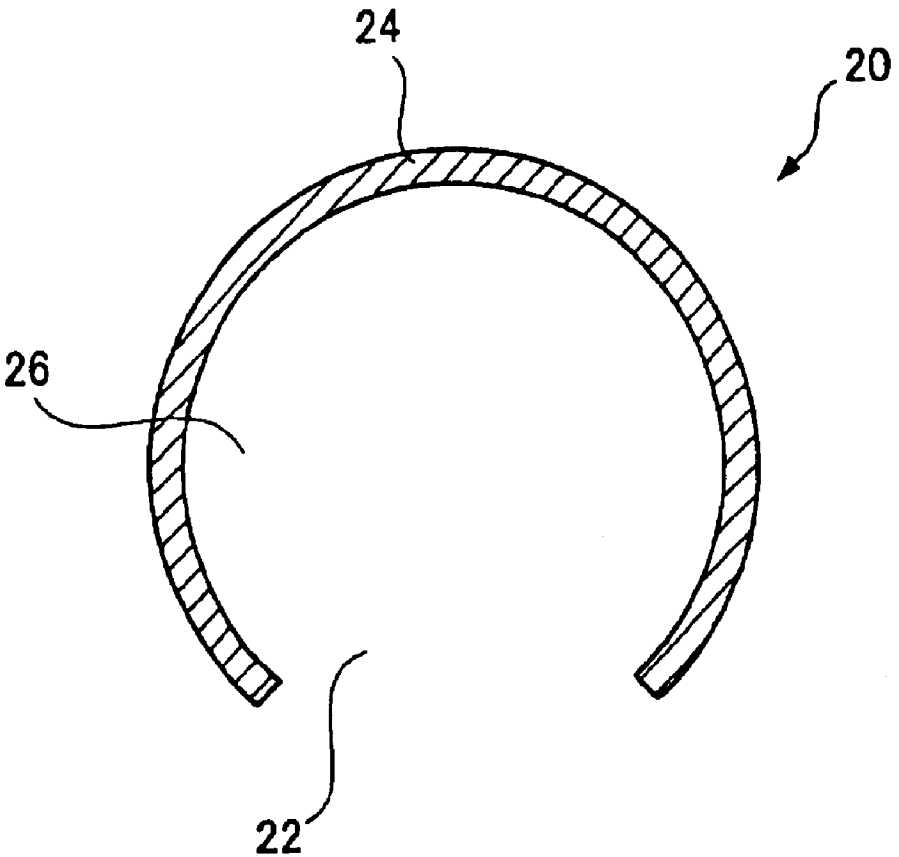
FIG. 9 shows a substantially spherically shaped non-grounded conductive object.

In FIGS. 5–7, schematic cross section views of various embodiments of the present invention are shown. Other examples of non-grounded conductive object 20 are shown in FIGS. 8 and 9.

FIG. 5 shows an example of non-grounded conductive object 20 wherein wall (shell) 24 is in the shape of a rectangular parallelepiped and acts as sidewalls and canopy for electromagnetic wave resonance part 12.

FIG. 6 shows an example in which non-grounded conductive object 20 is curved partially around electromagnetic wave resonance part 12.

FIG. 7 shows an example of antenna device 10 in which non-grounded conductive object 20 is thick.

FIG. 8 shows an example in which a non-conductive substance 28 is encased within double-walled, non-grounded, conductive object 20. While FIG. 8 shows wall 24 on the inside and outside of non-conductive substance 28, it is also sufficient to place wall 24 only on the inside or outside of non-conductive substance 28.

FIG. 9 discloses another embodiment of the present invention, wherein non-grounded conductive object 20 is substantially spherically shaped. However, it is also possible to completely enclose an antenna within a non-grounded conductive object.

The non-grounded conductive object 20 of the present invention, equipped with a conductive wall (or shell) 24, can generate induced current or an electric charge. The non-grounded conductive object 20 of the present invention is not grounded. The electric charge or current generated by the electromagnetic wave contacting the non-grounded conductive object 20 is confined in the wall (shell) 24, of the present invention.

Generally, if an antenna is covered by a conductive substance and this conductive substance is grounded, the inside can be shielded against external electromagnetic waves. The shielding effect is substantially different from that achieved by the present invention. The purpose of shielding is to protect the antenna from electromagnetic waves. The present invention increases the T/R efficiency by placing a non-grounded conductive object near the antenna. This results in an improved signal to noise ratio.

The present invention is suitable for radio communication systems, especially for wireless LAN with GHz band frequencies as well as systems utilizing the broadband characteristic of a discone type antenna. The present invention is suitable for antennas that reside on vehicles, buildings, airplanes, and satellites, as well as those used for cell phones and digital television signals.

Industrial Applicability:

The invention is further illustrated by the following non-limiting examples.

EXAMPLE 1

Figure 13:
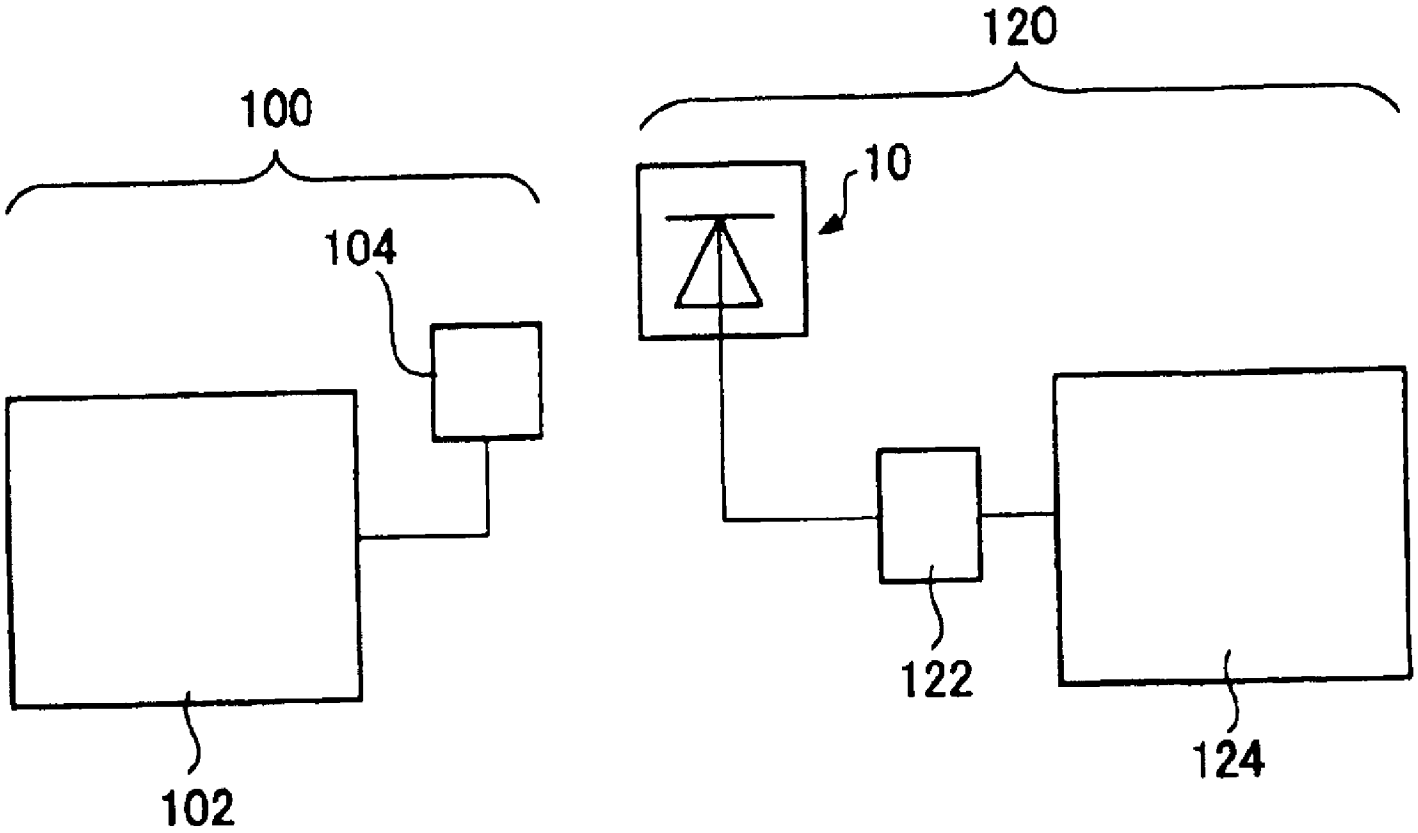
FIG. 13 is a schematic measurement arrangement view of an implementation of the present invention.

A schematic measurement arrangement view depicting an experimental setup is shown in FIG. 13. Transmitting equipment 100 was equipped with transmitting circuit part 102 and transmitting antenna 104. Receiving equipment 120 was comprised of antenna device 10, receiving antenna part 122, and receiving circuit part 124. Receiving circuit part 124 had an Automatic Gain Control (AGC) function built into it which stabilized the output signal.

Figure 12:
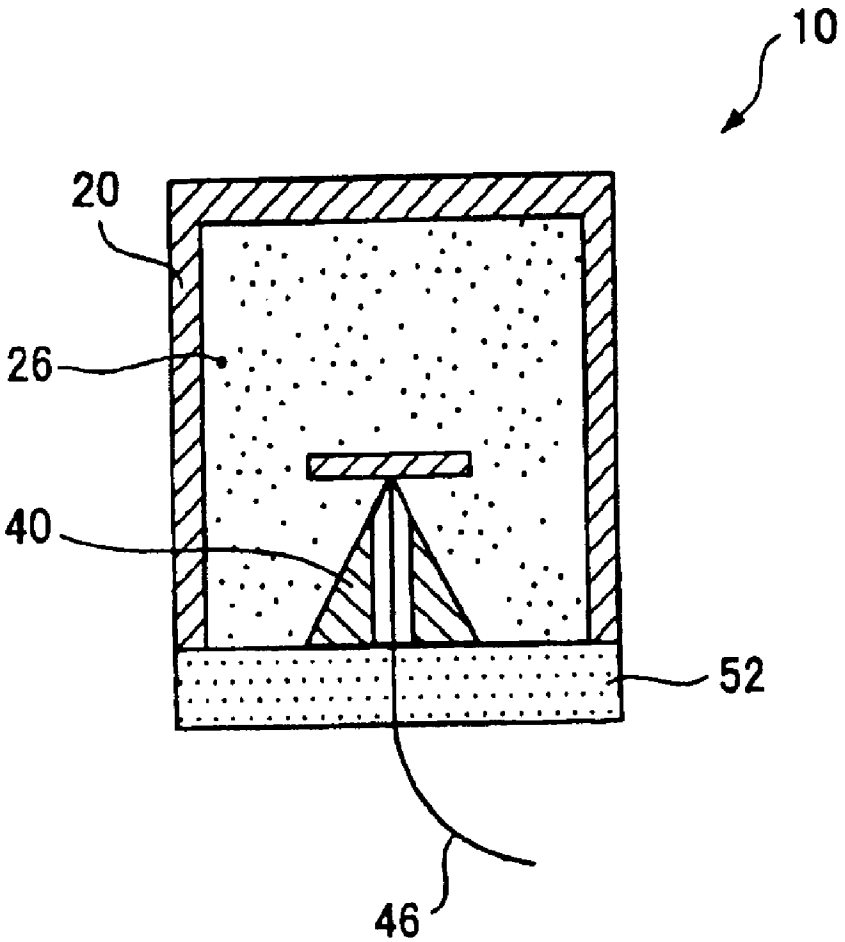
FIG. 12 is a detailed drawing of the antenna device depicted in FIG. 13.

FIG. 12 shows a detailed drawing of the antenna device depicted in FIG. 13. Antenna device 10 was composed of discone type antenna 40 and non-grounded conductive object 20. Insulative part 26 of non-grounded conductive object 20 was filled with insulator 26. Discone type antenna 40 was placed on insulating base 52, and feeding part 46 of discone type antenna 40 was extended outside through base 52.

In FIG. 13, the circuit of an IEEE 802.11b communication system (2.4 GHz band) was used as transmitting equipment 100, and a card with an external output-terminal of the communication system was used as receiving equipment 120.

In this example, a 2.4 GHz discone type antenna was used in conjunction with a non-grounded conductive object which was a rectangular parallelepiped (aluminum foil lining) with inner dimensions (ID) of 8 cm×8 cm×10 cm (height). The discone type antenna was so disposed that the perpendicular centerline of it and the center of the non-grounded conductive object coincided.

Figure 14:
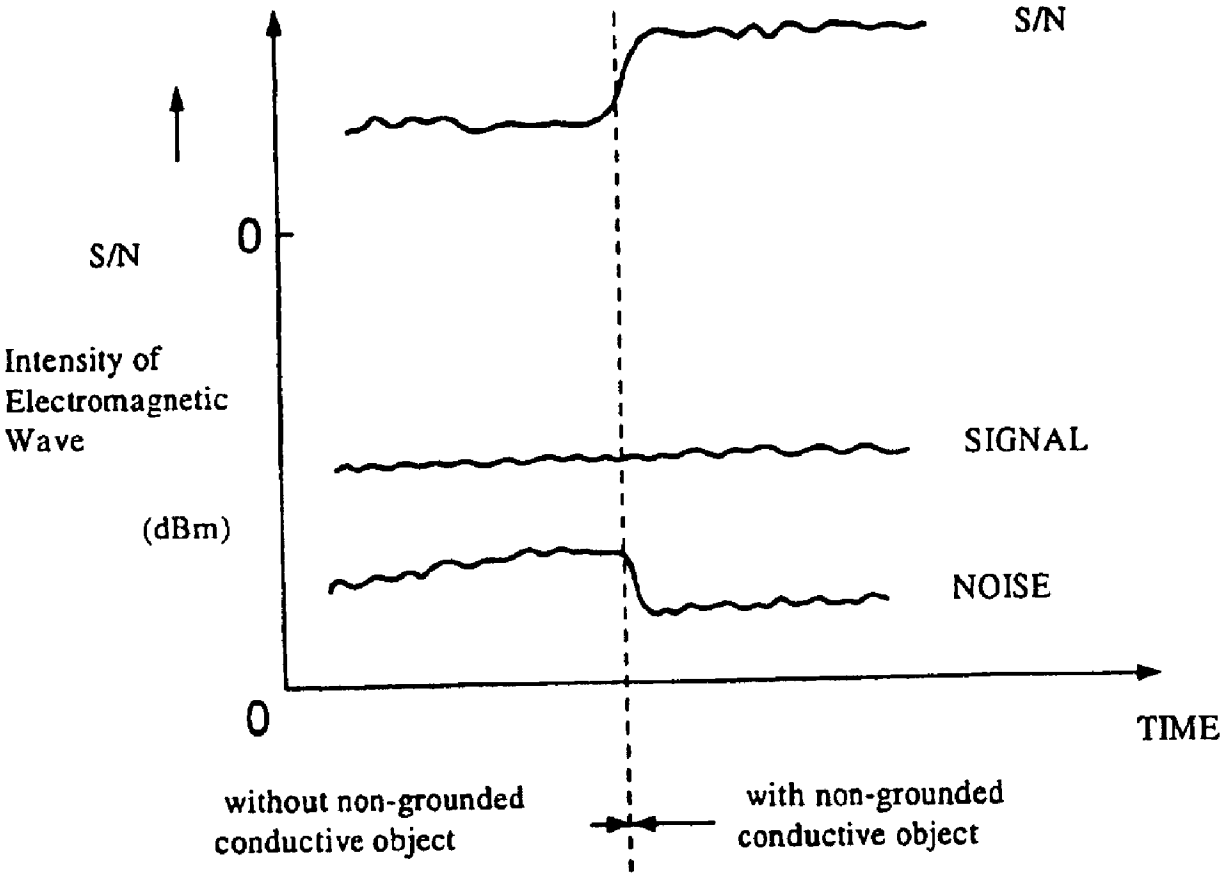
FIG. 14 is a chart showing the measurement result of electromagnetic wave intensity.

FIG. 14 is a chart depicting time on the horizontal axis and electric wave intensity on the vertical axis. The graph shows the dramatic affect in noise and signal to noise measurements at the moment the non-grounded conductive object was applied. As can be seen in FIG. 14, though the signal output remained virtually unchanged, the noise was reduced by 10 dBm. As a result, S/N ration was improved.

EXAMPLE 2

In the schematic measurement view of this experiment, shown in FIG. 13, a sine wave signal from 50 MHz to 30 GHz was generated from transmitting circuit part 102, then utilizing this signal, an electromagnetic wave was generated from discone type antenna 104 having a cone slant height of 3.8 cm and a cone flare angle of 60 degrees. The receiver employed another discone type antenna of the same shape and size as that used for the transmitter. The received electromagnetic wave's power was measured using a spectrum analyzer.

Figure 15:
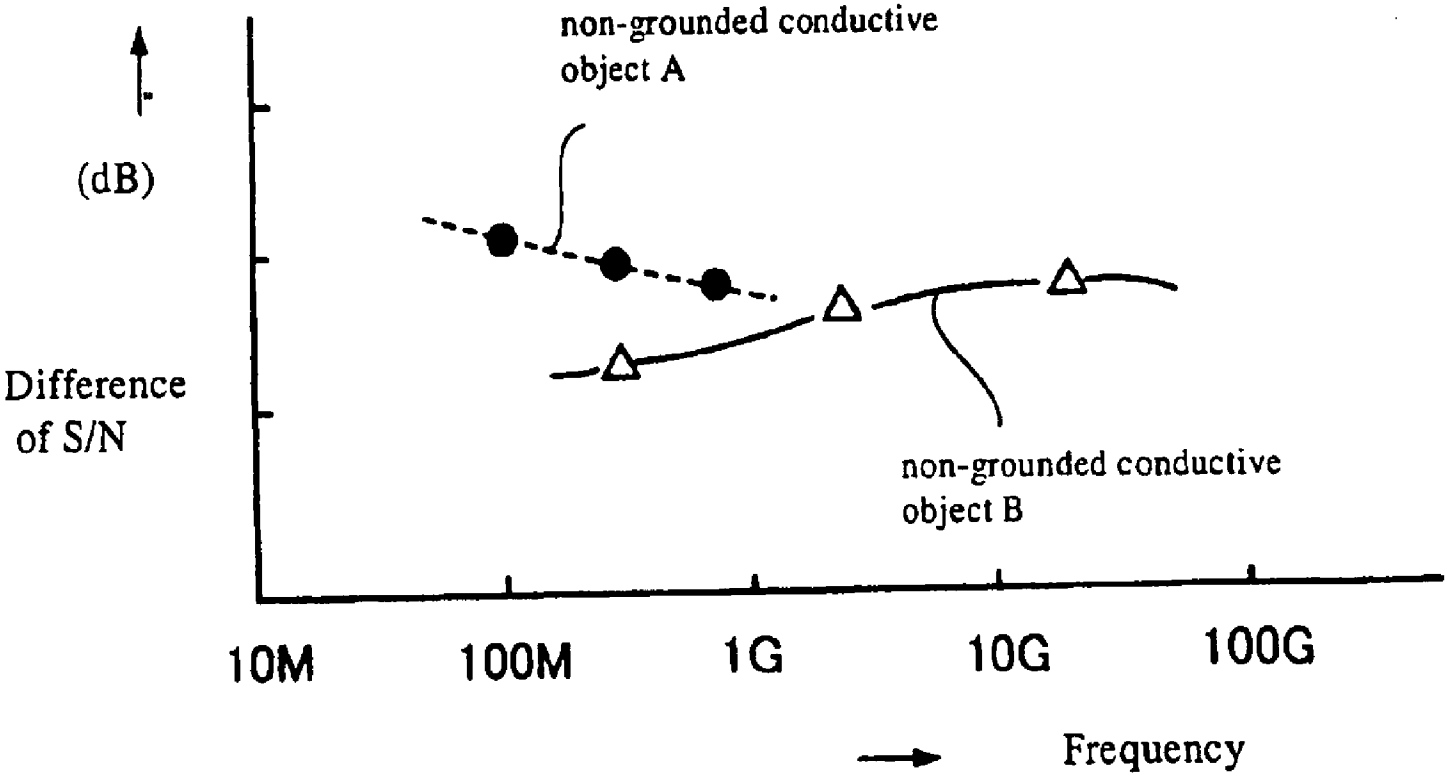
FIG. 15 is a graph showing the change in S/N ratio when the non-grounded conductive object is applied.

Two different non-grounded conductive objects were tested. Non-grounded conductive object A was cylindrically shaped, having a diameter of 25 cm and a height of 10 cm. Non-grounded conductive object B was also cylindrically shaped, however, its diameter was 8 cm with a height of 10 cm. Both of the conductive objects were made of aluminum. These conductive objects were then placed over the antenna and their effects recorded. These results are shown in FIG. 15. In FIG. 15, the horizontal axis shows frequency and the vertical axis shows signal to noise ratio in dB. One can see that for frequencies of less than approximately one GHz non-grounded conductive object A provides a better signal to noise ratio, however, for frequencies that are greater than approximately one GHz. the S/N ratio for non-grounded conductive object B is greater than that of A.

EXAMPLE 3

The S/N ratio was measured while varying the shape, material, and size of the non-grounded conductive object, using the same setup described in example 1. Results of this experiment are shown in Table 1.

TABLE 1

S/N Readings Obtained From Different Conductive Object Materials, Shapes, and Thicknesses

| | Non-grounded conductive object | | | | |
|---|---|---|---|---|---|
| No. | Material | Shape | I.D. (cm) | Thickness (mm) | Change in S/N (dB) |
| Ex. 3-1 | aluminum foil | rectangular parallelepiped | 8 × 8 × 10 (h) | 0.3 | 10 |
| Ex. 3-2 | Aluminum | cylinder | 25φ × 10 (h) | 1 | 2 |
| Ex. 3-3 | Steel | cylinder | 15φ × 17 (h) | 1 | 5 |
| Ex. 3-4 | Aluminum | rectangular parallelepiped | 22 × 17 × 14 (h) | 30 | 1.5 |
| Ex. 3-5 | Brass | cylinder 1 mm mesh | 15φ × 17 (h) | 0.5 (diameter of brass wire) | 5 |
| Ex. 3-6 | Polyethylene | cylinder | 15φ × 17 (h) | 0.2 | 0 |

EXAMPLE 4

The same setup was used as in Example 1, except that the S/N ratio was measured while raising the non-grounded conductive object above the discone type antenna. However, almost no change was noticed, even when part of the discone was exposed from the lower end of the non-grounded conductive object.

EXAMPLE 5

The same setup was used as in Example 1, except that an ordinary antenna for IEEE 802,11b system (2.4 GHz band) was used instead of the discone type antenna. A rectangular parallelepiped of 8 cm×8 cm×10 cm (height) was used for the non-grounded conductive object. This resulted in a 2 dB improvement in the Signal to Noise ratio.

EXAMPLE 6

Figure 16:
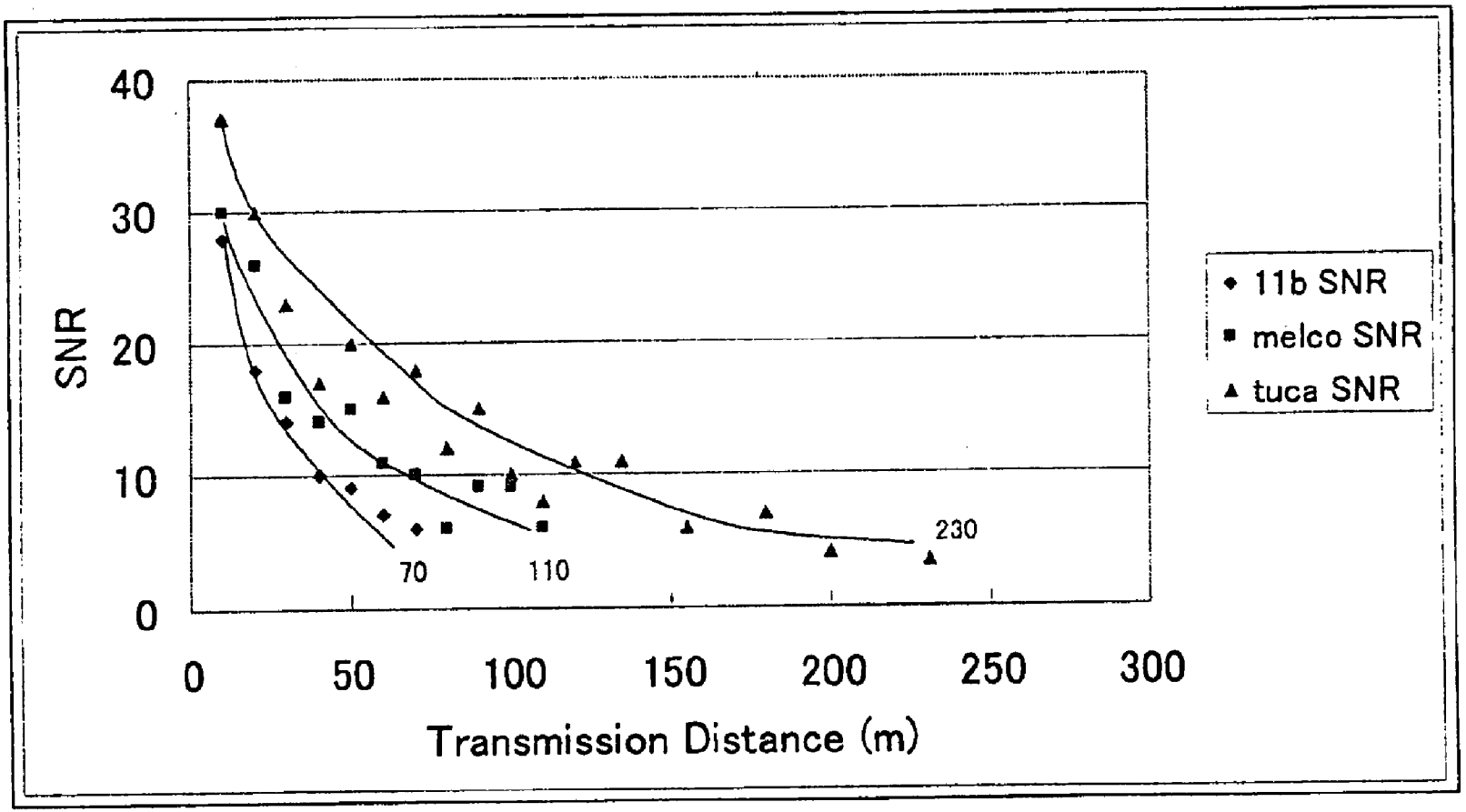
FIG. 16 is a graph showing the S/N ratio as distance is varied, for the current invention in the embodiment, shown in FIG. 1, as well as two prior art antennas.
Figure 17:
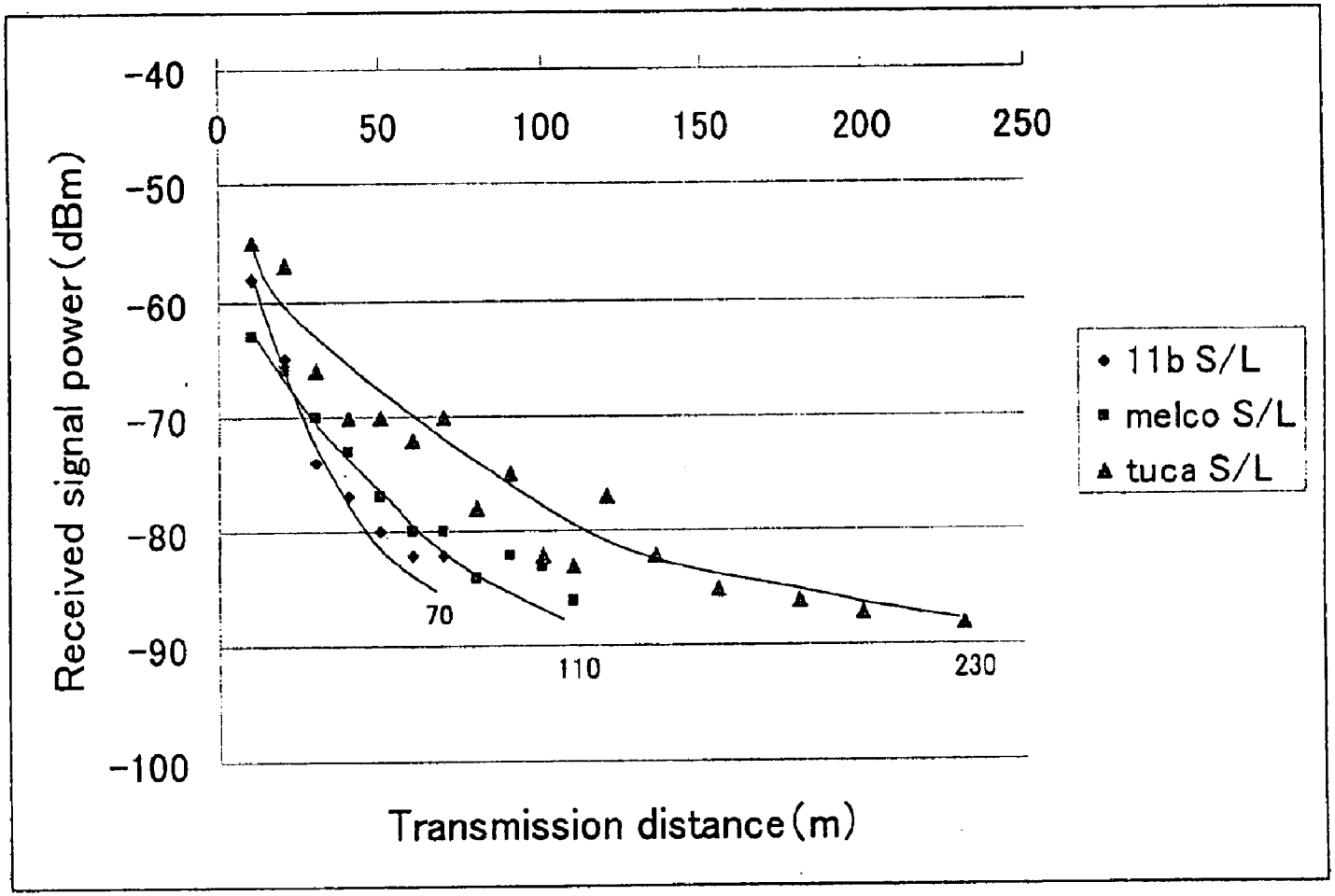
FIG. 17 is a graph showing the signal power, in dBm, received by the current invention as well as two prior art antennas, as distance is increased from the transmitter.

Using the setup depicted in FIG. 13, three different antennas were tested. The first, labeled 11*b*, was the standard personal computer (PC) card having only its internal antenna and no external antenna. The second set of measurements made, labeled as Melco, were obtained by applying an external antenna, made by Melco, to the standard PC card of the first measurement (11*b*). No conductive object was used in conjunction with the first two measurements. The third antenna used was similar to that depicted in FIG. 1, a discone type antenna having a curved non-grounded conductive object placed near it. Each receiving antenna was initially located next to the transmitter antenna. Each of the three receiving antennas was then moved to a distance of 230 meters from the transmitter, with multiple measurements of both S/N ratio and received power taken along the way. The results of these measurements were then plotted in graphs FIG. 16 and FIG. 17. Based on these graphs it is evident that the non-grounded conductive object resulted in a sizable increase not only in the received signal power, but also in the S/N ratio.

EXAMPLE 7

The setup described in Example 6 was used. Maintaining a constant non-varying distance from the transmitter to the receiver, measurements for each of the three antennas were taken. These measurements consisted of signal, noise, signal to noise ratio, and signal range. The results of these measurements are depicted in FIGS. 18–26.

Figure 22:
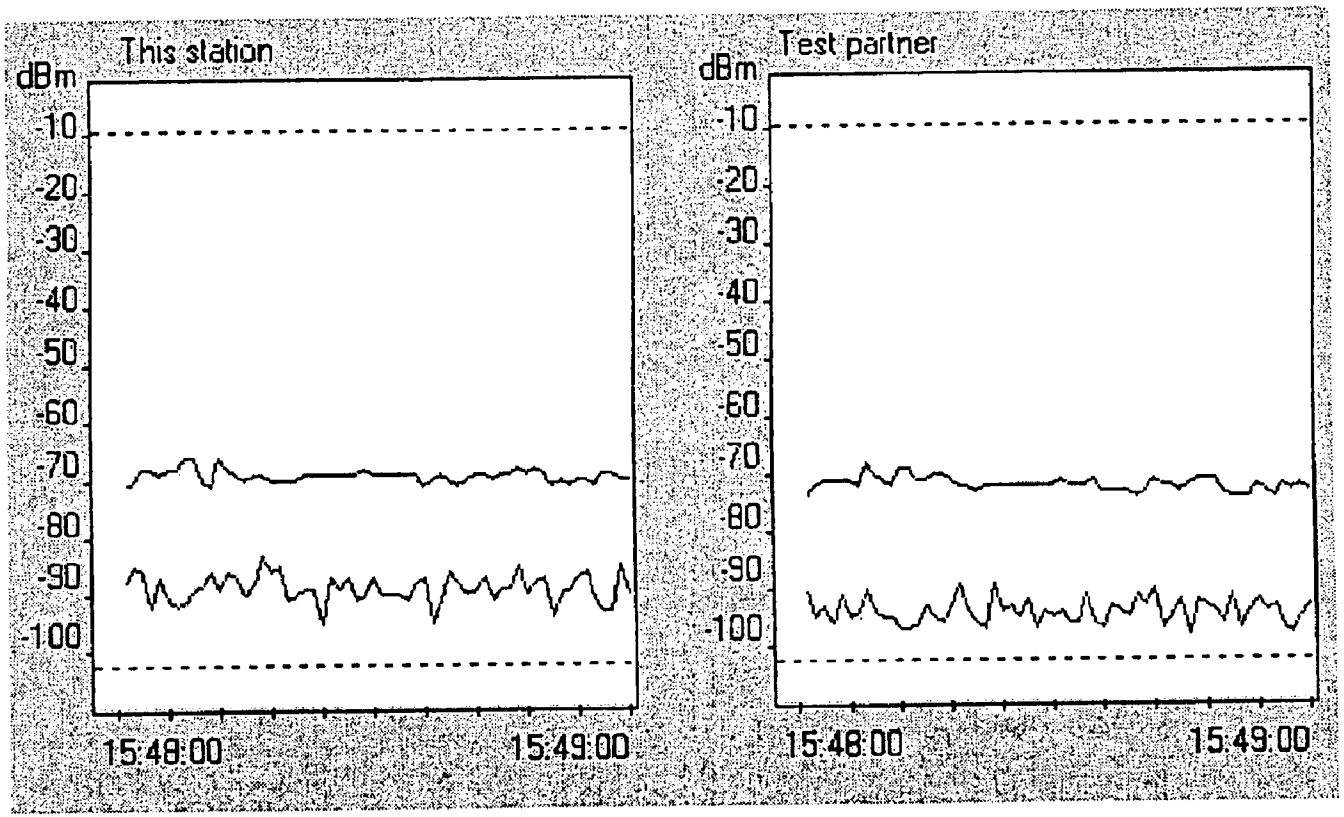
FIG. 22 is a graph showing signal and noise measurements for the discone type antenna with a curved non-grounded conductive object added.

FIG. 22 shows signal and noise readings obtained from a discone antenna with a curved non-grounded conductive object. Comparing the graph of this antenna with that of the Melco antenna (having no conductive object) and the PC card (also having no conductive object) with no external antenna (FIGS. 19 and 24 respectively), a definite advantage of the present invention can be seen. While the noise for each averaged around −90 dBm, the signal reading for the discone type antenna with a curved non-grounded conductive object averaged signal readings of about 10 dBm greater than the two antennas that had no conductive objects. These results are repeatable as evidenced by FIGS. 25 and 26, which show the same results produced from the same setup but taken at a different time.

Figure 18:
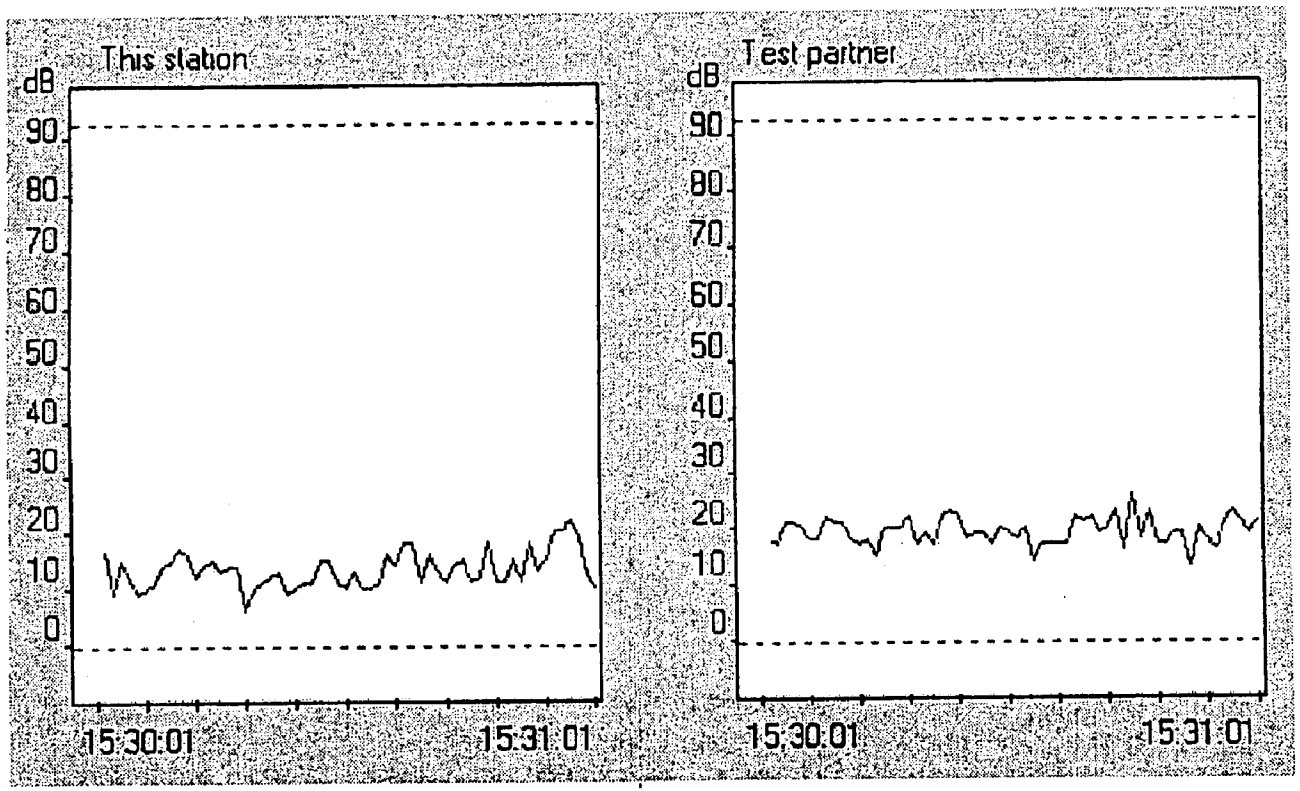
FIG. 18 is a graph showing the S/N for the Melco antenna without a non-grounded conductive object.
Figure 19:
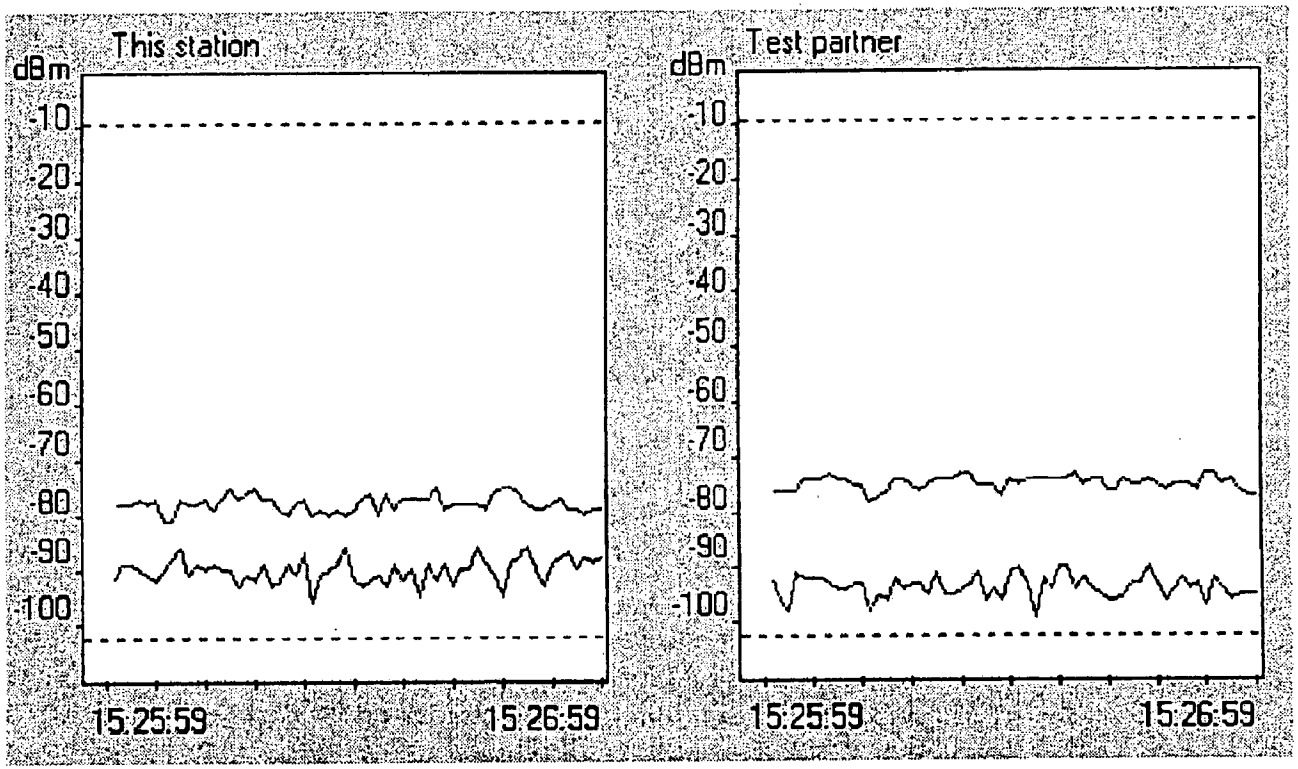
FIG. 19 is a graph showing signal and noise readings for the Melco antenna without a non-grounded conductive object.
Figure 20:
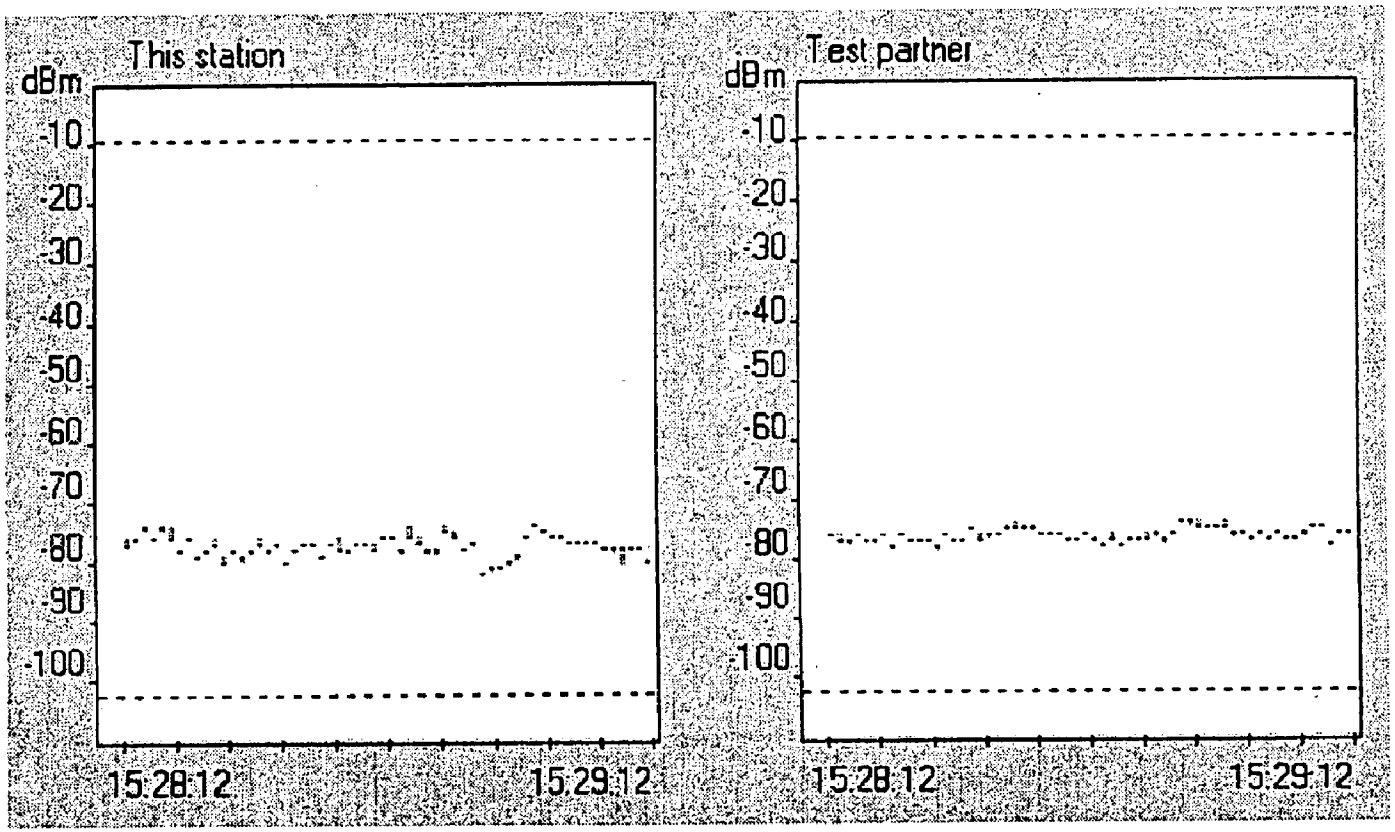
FIG. 20 is a graph showing the signal range for the Melco antenna without a non-grounded conductive object.
Figure 21:
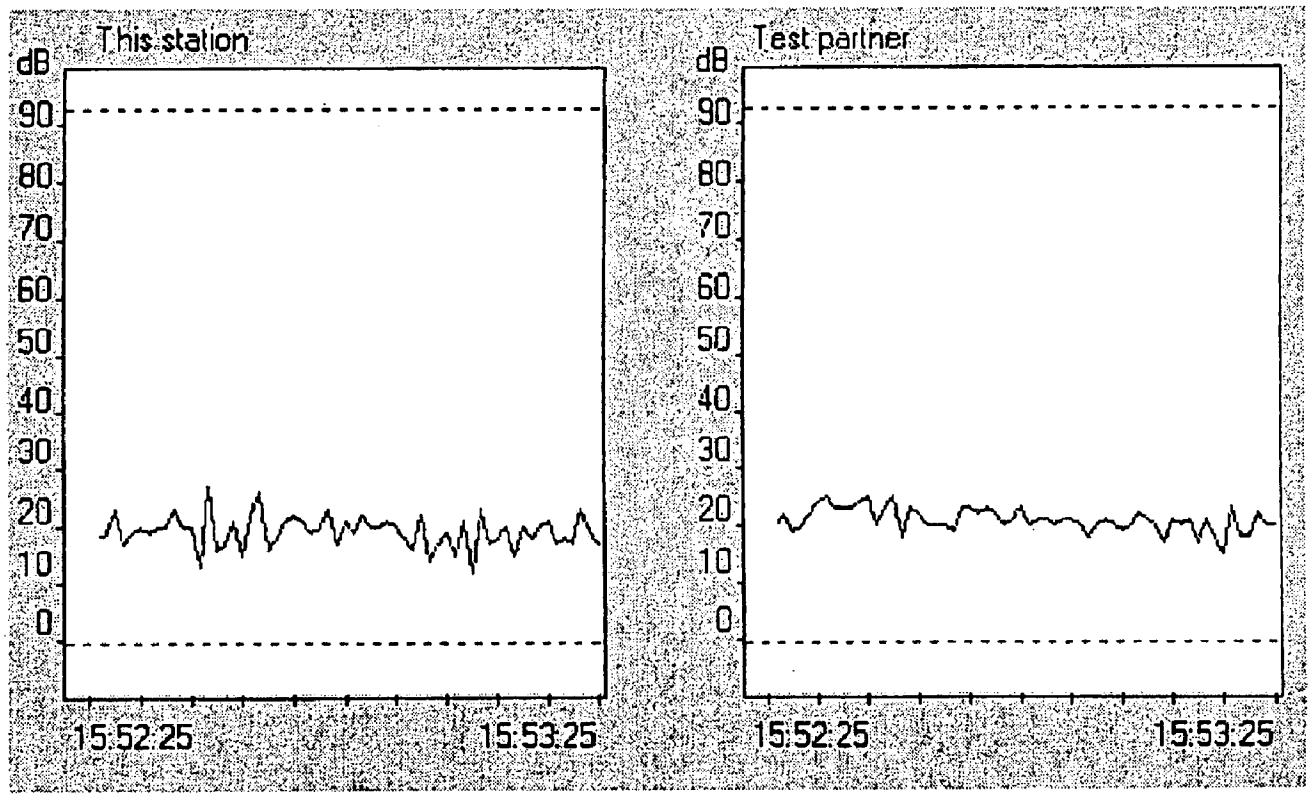
FIG. 21 is a graph showing the S/N for the discone type antenna with a curved non-grounded conductive object added.
Figure 23:
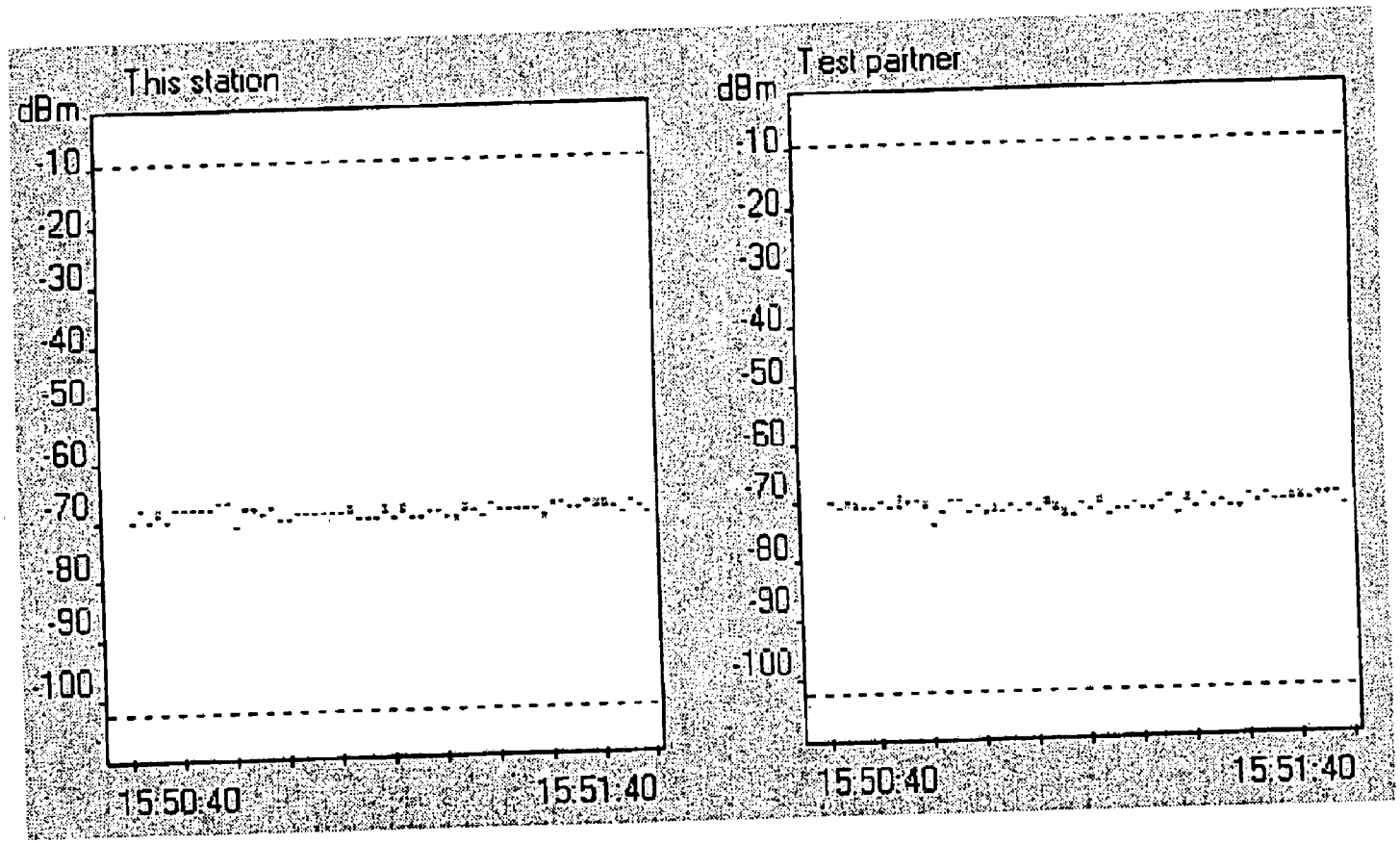
FIG. 23 is a graph showing the signal range for the discone type antenna with a curved non-grounded conductive object added.
Figure 24:
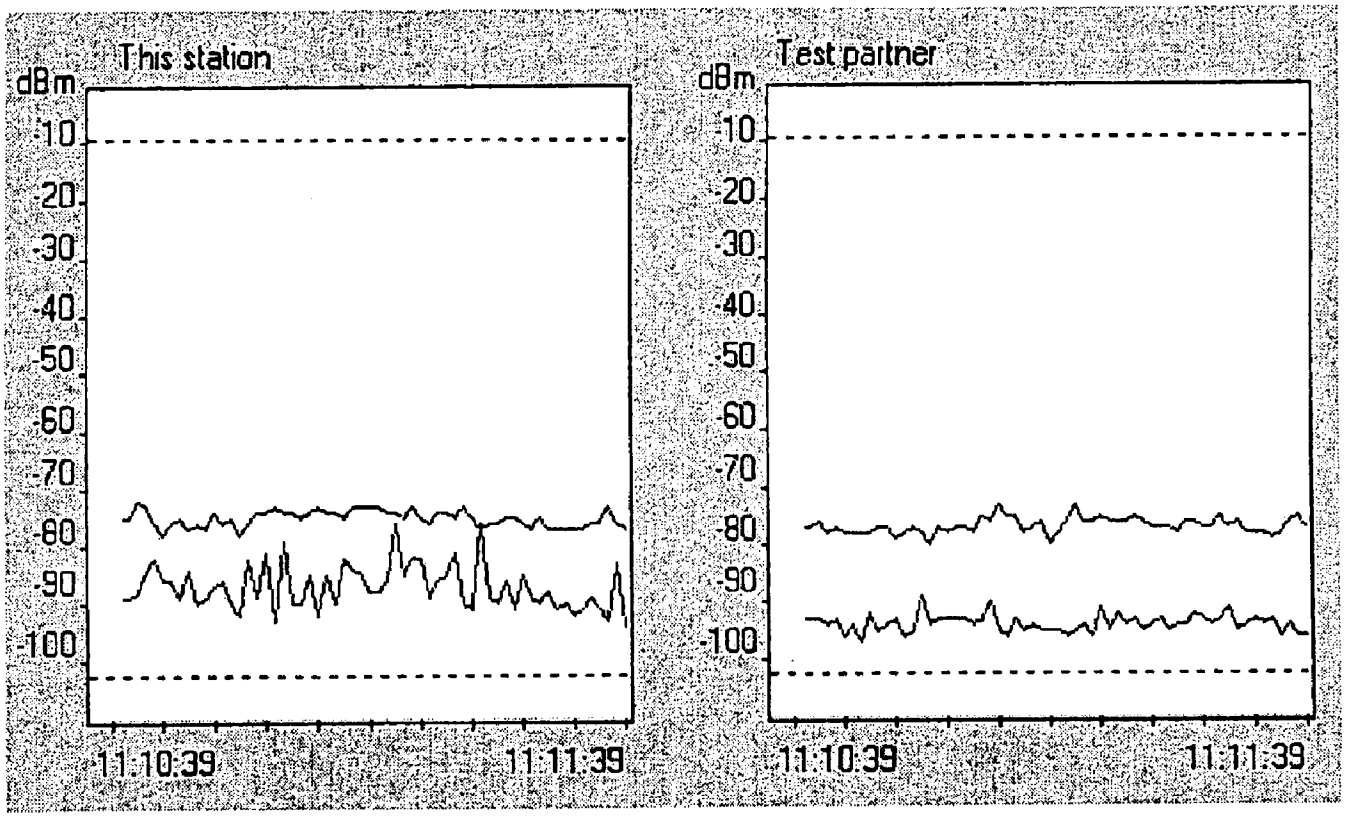
FIG. 24 is a graph showing signal and noise readings for the PC card with no external antenna.
Figure 25:
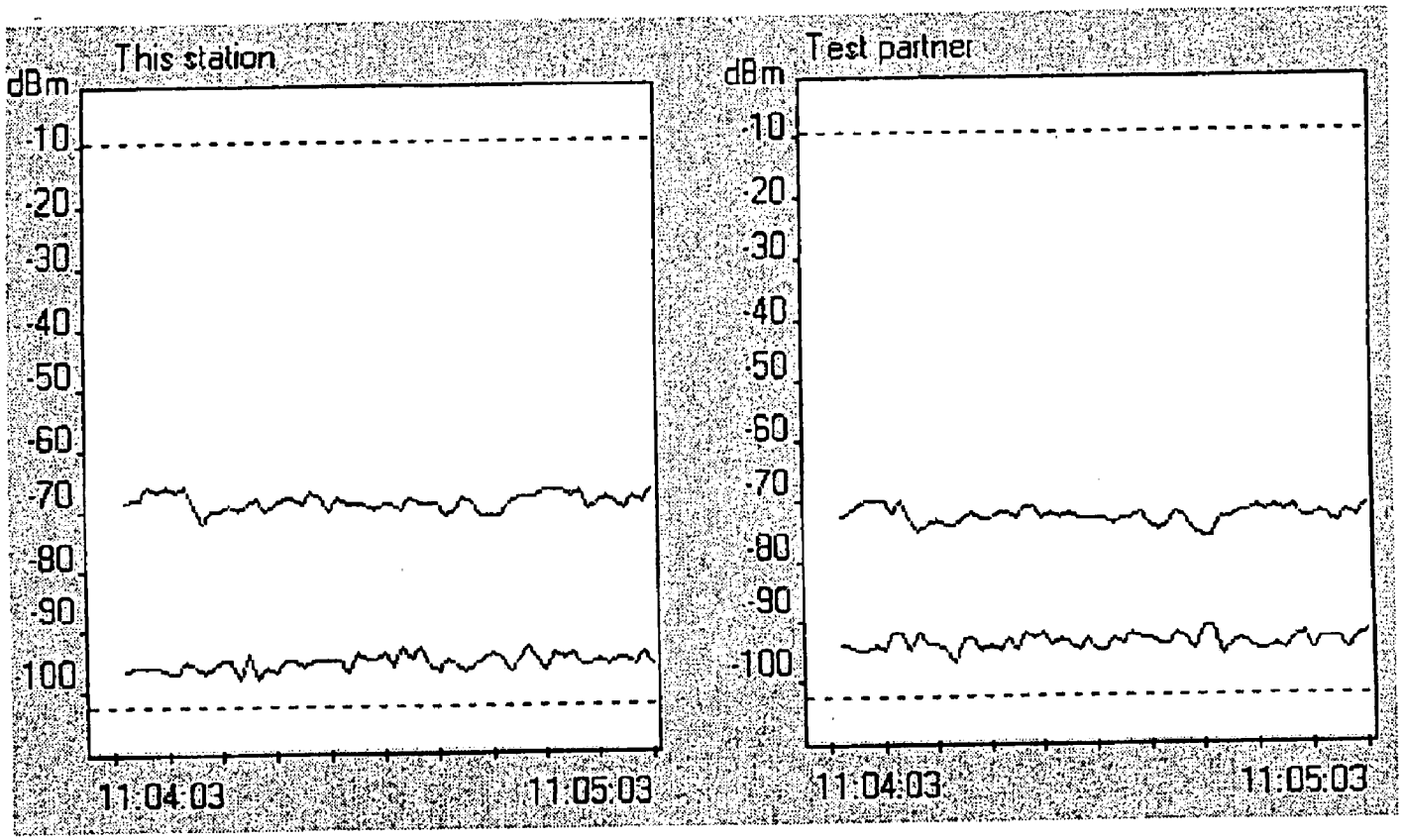
FIG. 25 is a graph showing the signal to noise ratio for the discone type antenna with a curved non-grounded conductive object added.
Figure 26:
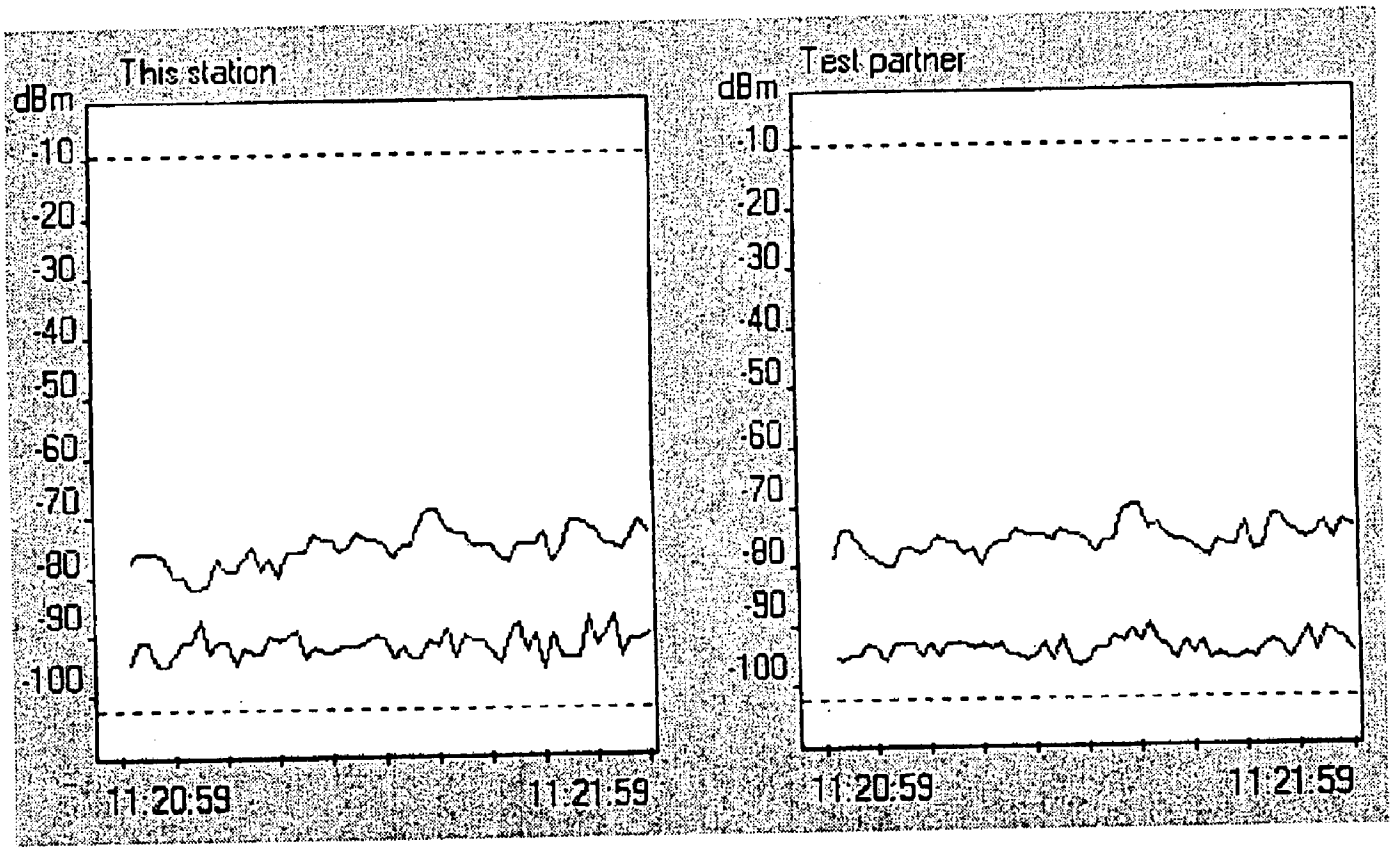
FIG. 26 is a graph showing signal and noise readings for the Melco antenna without a non-grounded conductive object.

S/N readings for the Melco antenna, with no conductive object, and the discone type antenna, having a curved non-grounded conductive object, are shown in FIGS. 18 and 21 respectively. Looking at these readings, an increase in the S/N of approximately 10 dBm is readily detectable for the discone type antenna having a curved non-grounded conductive object. FIG. 20 shows the signal range for the standard Melco antenna, while FIG. 23 shows the signal range for the discone type antenna with a curved non-grounded conductive object. Based on these graphs, one can see that not only is the signal of the discone antenna, with the non-grounded conductive object, higher, but it also has less variation with time, hence an antenna with a non-grounded conductive object produces a smother signal.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An apparatus for improving transmission and/or reception efficiency of a discone antenna comprising:

the discone antenna;

a non-grounded conductive object; and an insulated space lying between said antenna and said non-grounded conductive object.

2. The antenna apparatus of claim 1 wherein said discone antenna comprises:

a disc;

a cone including an apex, a height and a base having a diameter, said disc positioned at said apex of said cone; and a feed wire disposed in an interior of said cone and extending outwardly beyond said cone.

3. The antenna apparatus of claim 1 wherein said non-grounded conductive object comprises aluminum material.

4. The antenna apparatus of claim 1 wherein said non-grounded conductive object comprises copper material.

5. The antenna apparatus of claim 1 wherein said non-grounded conductive object is substantially flat.

6. The antenna apparatus of claim 1 wherein said non-grounded conductive object is curved.

7. The antenna apparatus of claim 6 wherein said non-grounded conductive object is substantially spherically shaped.

8. The antenna apparatus of claim 6 wherein said non-grounded conductive object is cylindrically shaped.

9. The antenna apparatus of claim 1 wherein said non-grounded conductive object is less than or equal to approximately ten millimeters in thickness.

10. The antenna apparatus of claim 1 wherein said non-grounded conductive object includes a double wall.

11. The antenna apparatus of claim 10 wherein said double wall defines a hollow interior.

12. The antenna apparatus of claim 11 wherein said hollow interior comprises insulative material disposed therein.

13. The antenna apparatus of claim 12 wherein said insulative material is plastic.

14. The antenna apparatus of claim 1 wherein said non-grounded conductive object completely encloses said antenna.

15. The antenna apparatus of claim 1 wherein said non-grounded conductive object partially encloses said antenna.

16. The antenna apparatus of claim 1 wherein said insulated space comprises air.

17. The antenna apparatus of claim 1 wherein said insulated space is plastic.

18. The antenna apparatus of claim 1 wherein said insulated space is less than or equal to approximately 50 millimeters in thickness.

19. The antenna apparatus of claim 1 wherein said non-grounded conductive object comprises an angle of between approximately 60 degrees and approximately 180 degrees.

20. A method for improving transmission and/or reception efficiency of a discone antenna, the method comprising the steps of:

providing the discone antenna; and disposing a non-grounded conductive object completely or partially within a passing area of electromagnetic waves that are received by or transmitted from the antenna.

21. The method of claim 20 wherein the step of providing the discone antenna comprises providing a cone comprising an apex, a height and a base comprising a diameter, and a disc positioned at the apex of the cone; and a feed wire disposed in an interior of the cone and extending outwardly beyond the cone.

22. The method of claim 20 wherein the step of disposing the non-grounded conductive object comprises providing a curved non-grounded conductive object.

23. The method of claim 20 wherein the step of disposing the non-grounded conductive object comprises completely enclosing the antenna within the non-grounded conductive object.

24. The method of claim 20 wherein the step of disposing the non-grounded conductive abject comprises partially enclosing the antenna within the non-grounded conductive object.

25. An apparatus for improving transmission and/or reception efficiency of a discone antenna comprising:

the discone antenna, including a cone having a base;

a non-grounded conductive object disposed above a horizontal plane through the base of the cone; and an insulated space lying between said antenna and said non-grounded conductive object.

* * * * *